United States Patent [19]

Booth et al.

[11] 4,435,941

[45] * Mar. 13, 1984

[54] PACKAGING MACHINE

[75] Inventors: John L. Booth, Richton Park; Peter A. Rittmaster, Chicago, both of Ill.

[73] Assignee: Booth Manufacturing Company, Vero Beach, Fla.

[ * ] Notice: The portion of the term of this patent subsequent to Nov. 18, 1997 has been disclaimed.

[21] Appl. No.: 207,690

[22] Filed: Nov. 17, 1980

Related U.S. Application Data

[63] Continuation of Ser. No. 6,085, Jan. 25, 1979, Pat. No. 4,233,802, and a continuation-in-part of Ser. No. 876,841, Feb. 10, 1978, abandoned.

[51] Int. Cl.[3] ..... B65B 5/08; B65B 5/06

[52] U.S. Cl. ..... 53/475; 53/448; 53/474; 53/538; 53/539; 53/247; 53/250

[58] Field of Search ..... 53/157, 246, 247, 250, 53/443, 445, 448, 458, 473, 474, 475, 537, 538, 539, 543, 564

[56] References Cited

U.S. PATENT DOCUMENTS

| | | | |
|---|---|---|---|
| 3,300,945 | 1/1967 | Grossi et al. | 53/473 X |
| 3,318,068 | 5/1967 | Voullaire | 53/537 |
| 3,431,698 | 3/1969 | Bathellier | 53/157 X |
| 3,683,582 | 8/1972 | Seguin | 53/448 |

FOREIGN PATENT DOCUMENTS

| | | | |
|---|---|---|---|
| 1105105 | 11/1955 | France | 53/445 |
| 1314057 | 4/1973 | United Kingdom | 53/445 |

*Primary Examiner*—Horace M. Culver

*Attorney, Agent, or Firm*—Dressler, Goldsmith, Shore, Sutker & Milnamow, Ltd.

[57] ABSTRACT

A packaging machine for automatically packaging articles in a honeycomb structure which includes mechanisms for providing a honeycomb structure in an expanded condition in a loading station. The articles to be packaged are directed into the loading station, dropped into the expanded honeycomb structure, and the articles and honeycomb are subsequently dropped into the container. This is automatically done on a repeated basis until the container is filled, after which the container is automatically moved out of the loading station and a new container is moved into place.

14 Claims, 40 Drawing Figures

FIG. 1
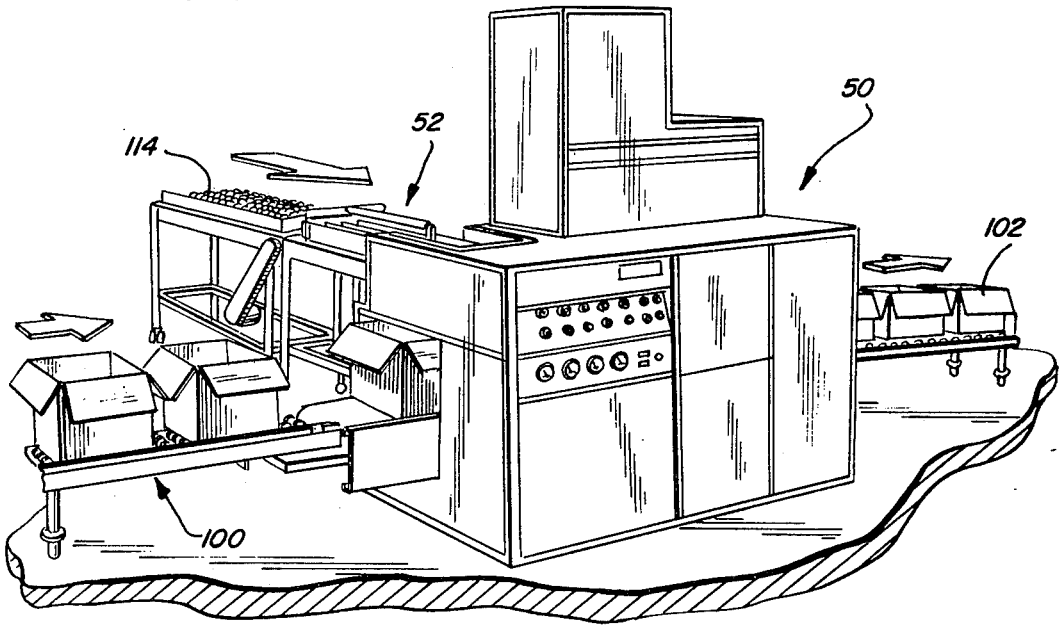
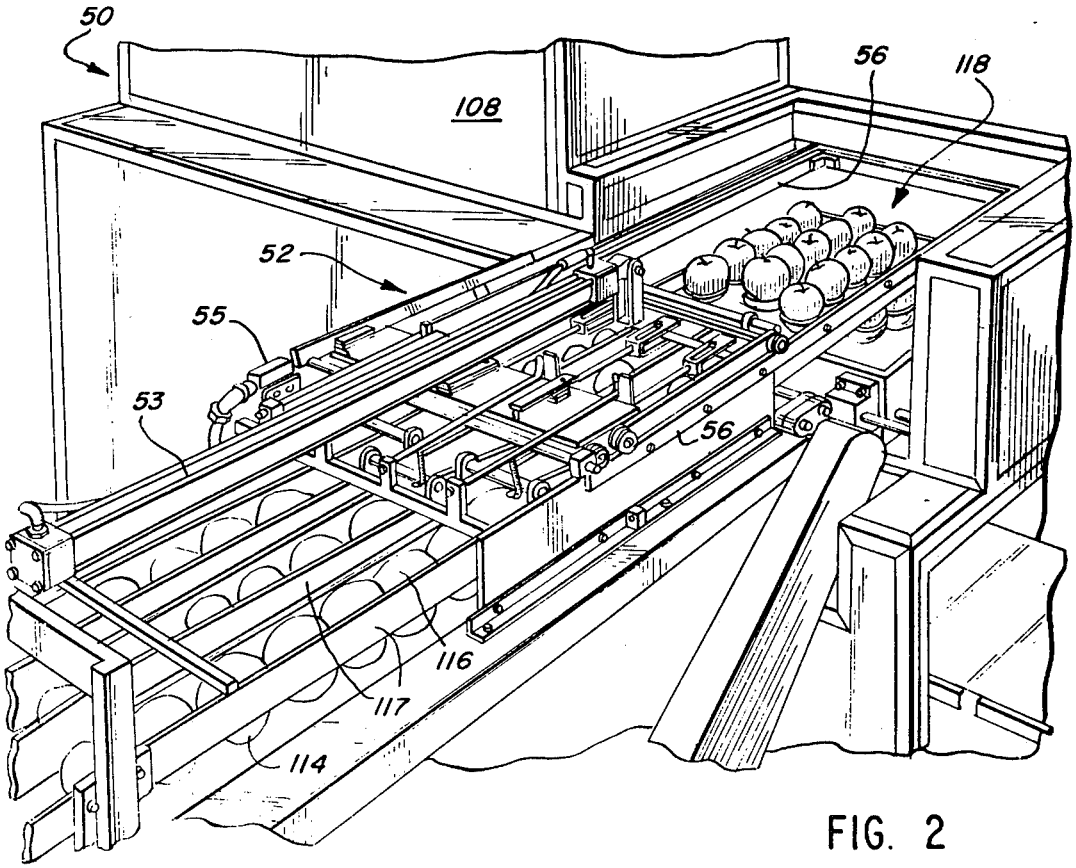
FIG. 2

FIG. 6
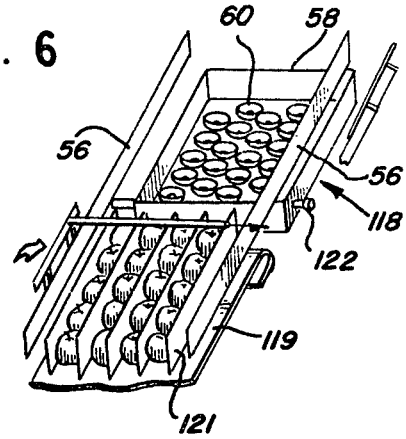
FIG. 7
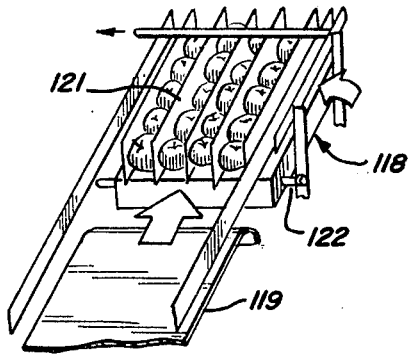
FIG. 8
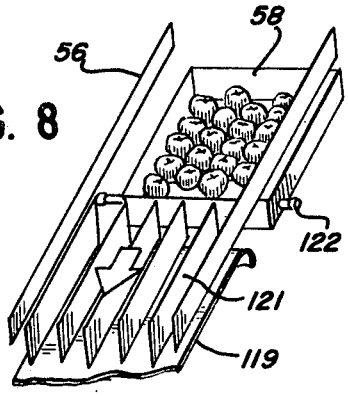
FIG. 9
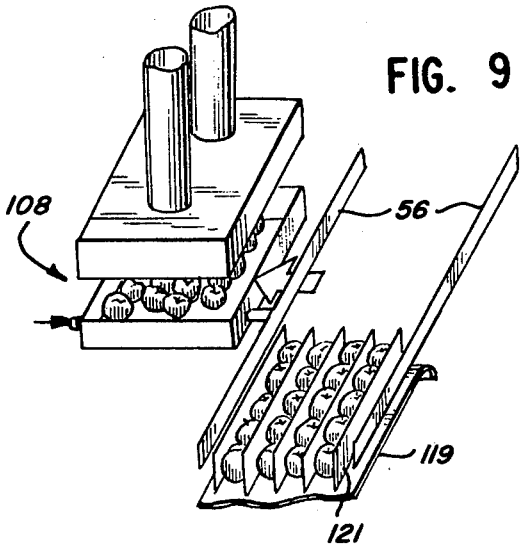
FIG. 10
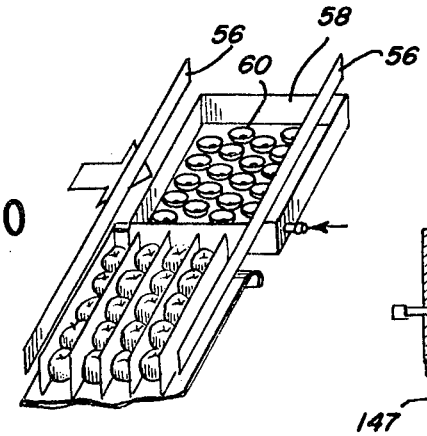
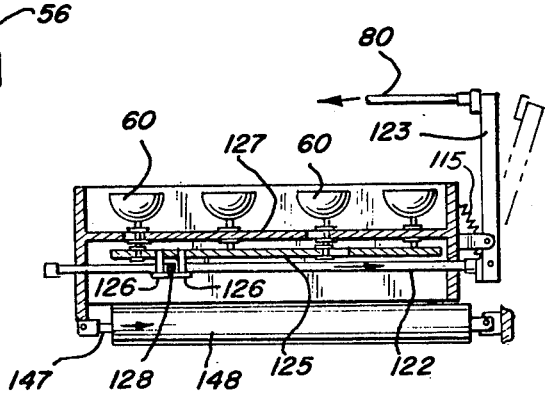
FIG. 17

86
84
82
54
72
71
56
70
93
92
74
76
78
90
80
64
68
66
81
98
94
95
117
15
88

FIG. 21
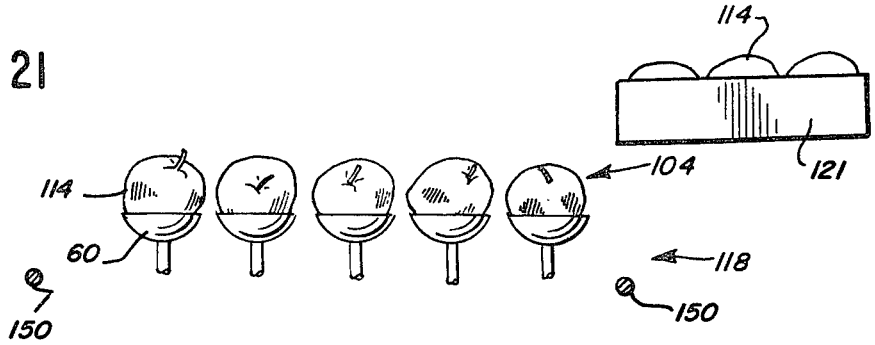
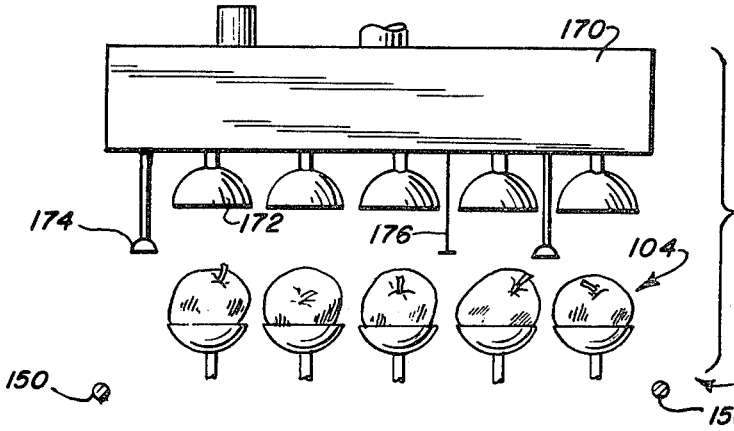
FIG. 22
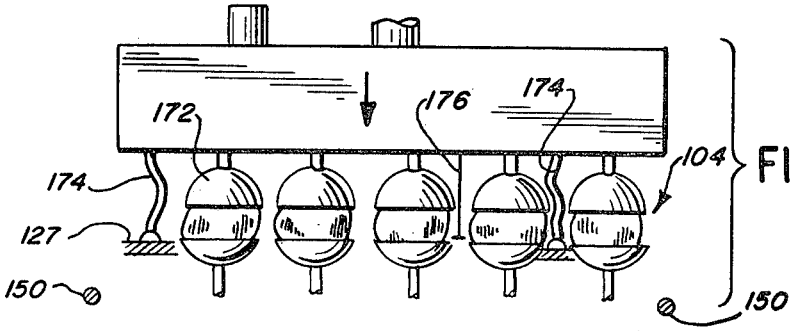
FIG. 23
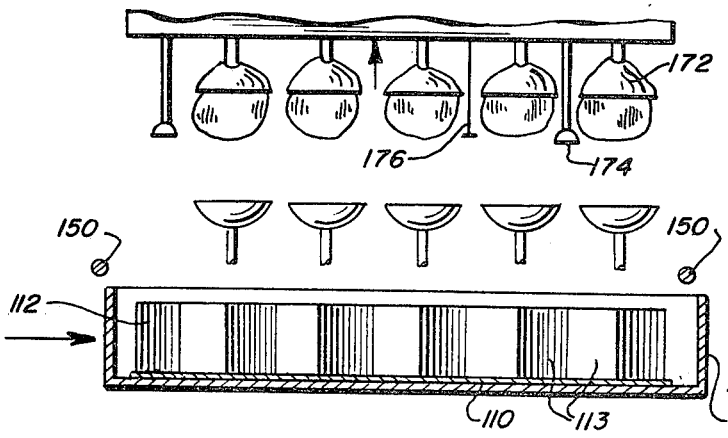
FIG. 24

FIG 29
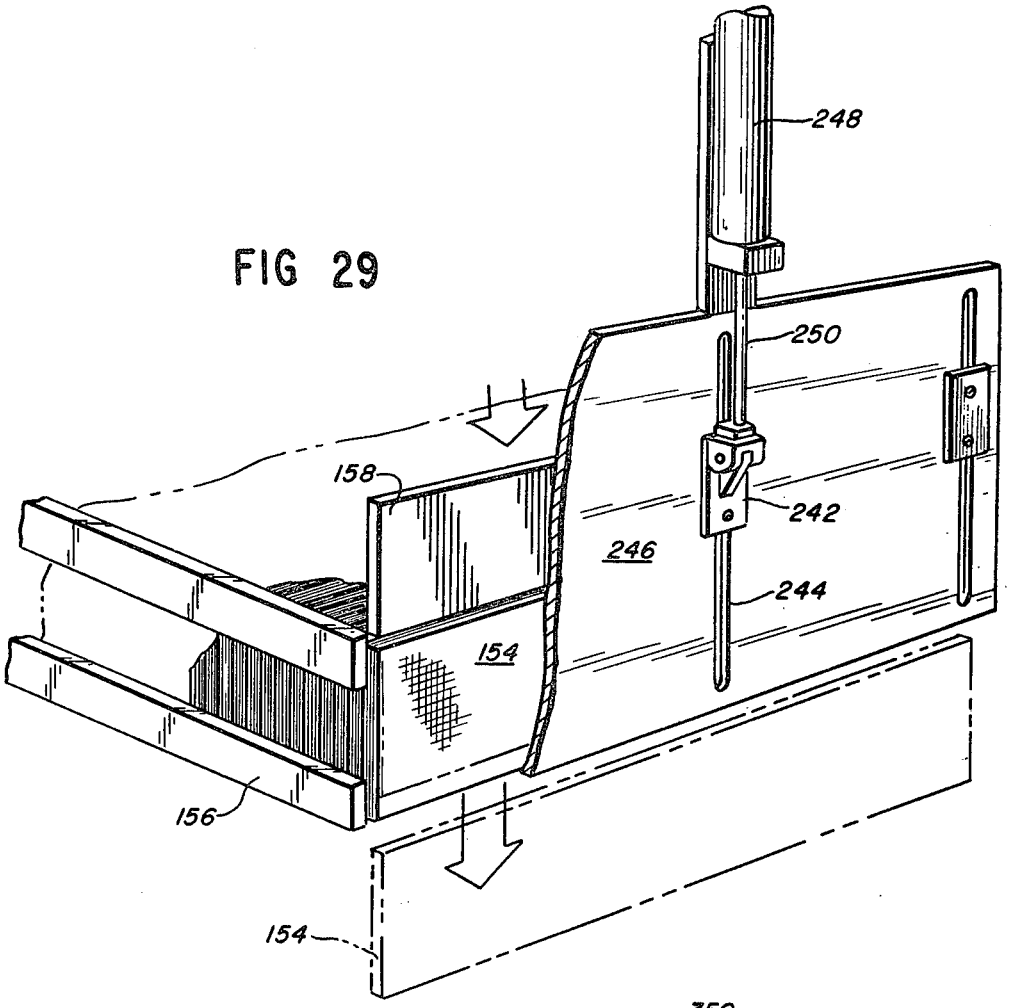
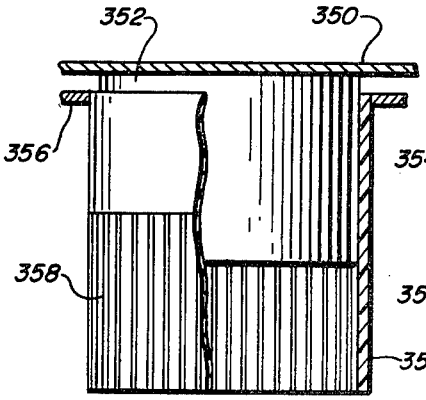
FIG. 37
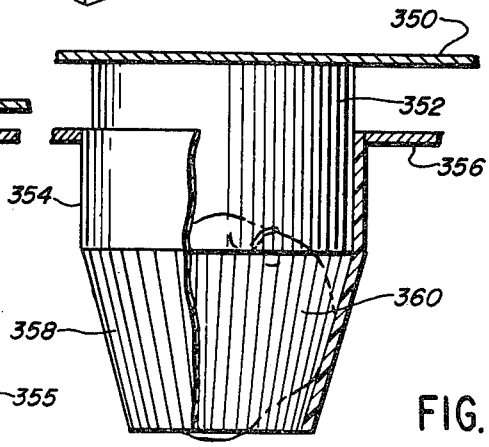
FIG. 38

FIG. 33
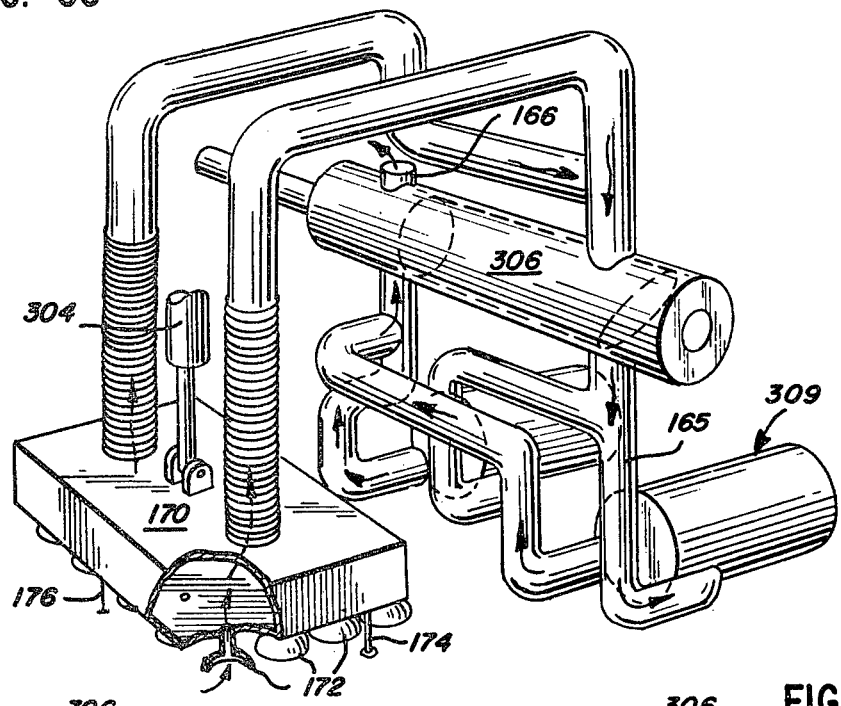
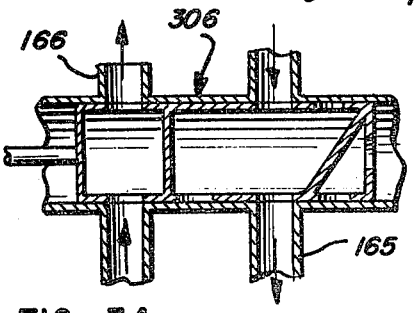
FIG. 34
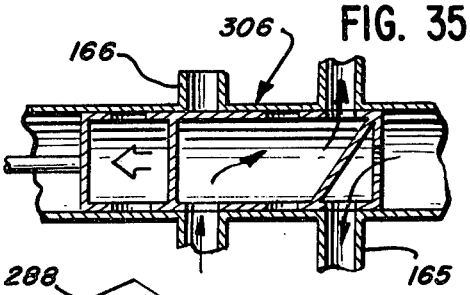
FIG. 35
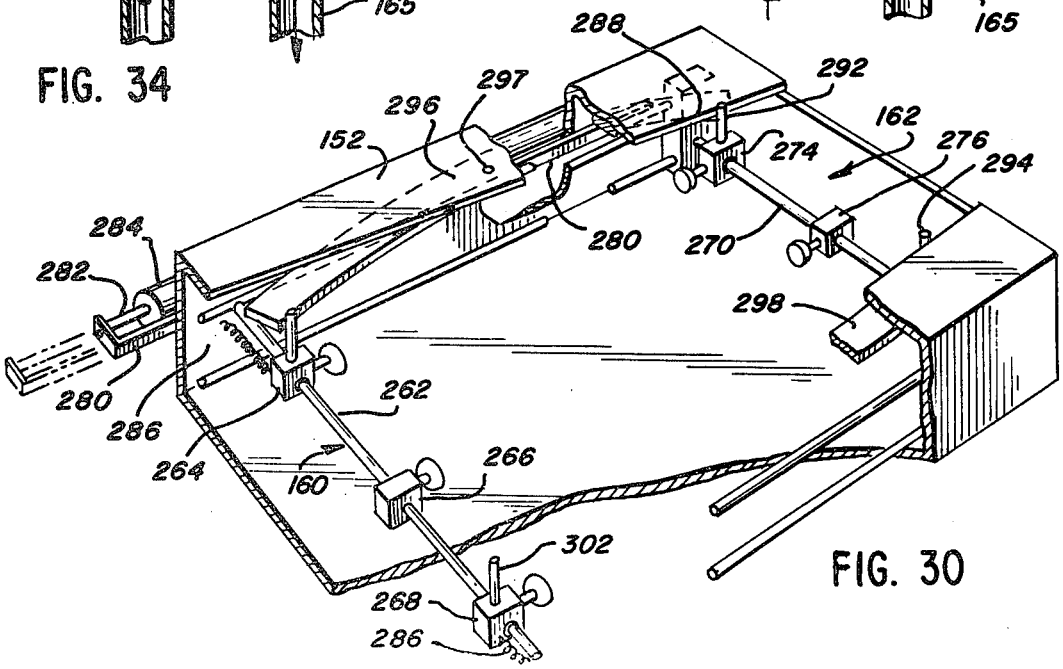
FIG. 30

START
STOP
82
KNOCKER BAR
OP
CL
CARRIAGE IN PLACE
CARRIAGE LOCATOR
57
TIMER
53
CARRIAGE SOL
119
FEEDER CONVEYOR
C
BLOWER
R1
VACUUM
R2
PRESSURE SWITCH
CONTAINER CONVEYOR
318
R3
BOX LOCATOR SWITCH
CONVEYOR KNIFE GATE
SOL.
185
CONVEYOR SOL.
UP
DN
CARRIER ASSEMBLY
PICK UP POSITION
SOL
DISCHARGE POSITION
320

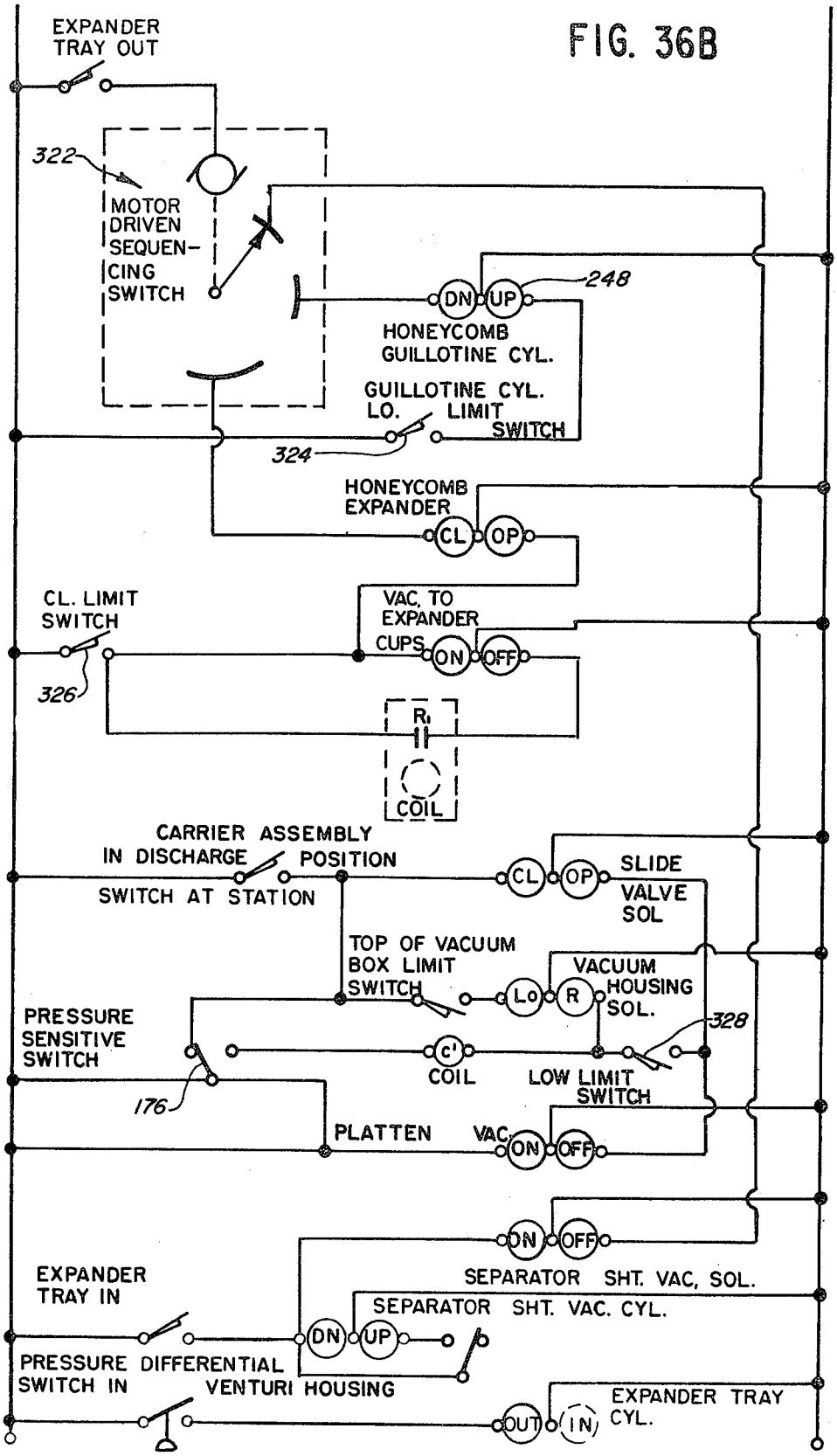
FIG. 36B
EXPANDER TRAY OUT
322
MOTOR DRIVEN SEQUEN-CING SWITCH
DN
UP
248
HONEYCOMB GUILLOTINE CYL.
GUILLOTINE CYL. LO. LIMIT SWITCH
324
HONEYCOMB EXPANDER
CL
OP
CL. LIMIT SWITCH
326
VAC. TO EXPANDER CUPS
ON
OFF
R
COIL
CARRIER ASSEMBLY IN DISCHARGE POSITION SWITCH AT STATION
CL
OP
SLIDE VALVE SOL
TOP OF VACUUM BOX LIMIT SWITCH
Lo
R
VACUUM HOUSING SOL.
328
PRESSURE SENSITIVE SWITCH
C'
COIL
LOW LIMIT SWITCH
176
PLATTEN
VAC.
ON
OFF
ON
OFF
SEPARATOR SHT. VAC. SOL.
EXPANDER TRAY IN
SEPARATOR SHT. VAC. CYL.
DN
UP
PRESSURE DIFFERENTIAL SWITCH IN
VENTURI HOUSING
OUT
IN
EXPANDER TRAY CYL.

PACKAGING MACHINE

This is a continuation of application Ser. No. 6,085, filed Jan. 25, 1979, and now U.S. Pat. No. 4,233,802.

This is a continuation-in-part application of Ser. No. 876,841, filed Feb. 10, 1978 and now abandoned.

This invention relates to a machine for automatically packaging articles of various types in containers wherein they will be placed in separate compartments, so they can be shipped great distances without damage. In the particular embodiment to be described and illustrated, the machine will be employed in the packaging of fruit.

The packaging of fruit for shipping over large distances must be done in such a manner that the fruit will not contact each other. A fruit in a container, if not positively separated and retained in a spaced apart relationship, will over the course of its travel rub against each other literally thousands of times, which will tend to bruise the fruit, resulting in substantial loss.

There are currently several kinds of packaging methods being employed, and, in one way, or another, they suffer from various disadvantages. A typical packaging operation is one in which a plurality of fruits, such as, apples, grapefruits, etc., are merely placed at random in a container, and the container is sealed and transported from where the fruit is grown to a store where it is sold to the ultimate consumer. It can be appreciated that when fruit is loosely disposed in a container in this manner, the moving around and subsequent abrasive action to which the contacting fruits are subjected due to their constant rubbing against one another when carried on vehicles, such as, trains, trucks, etc., will result in substantial damage to the fruit. In some instances, the damage has run as high as ten, twenty percent, or even more, which obviously is a serious disadvantage.

Another way fruit is being currently packaged is to put it in plastic trays that may, or may not be covered by a thin plastic sheet. These trays are then individually put into larger boxes, one on top of the other until the box is full. While this is better than loosely packaging the fruit, this is still not fully satisfactory, since the bottom of all trays, but one, will repeatedly rub against an adjacent row of fruit and cause damage.

Obviously any packaging method that would completely separate the individual fruits from each other and keep them always apart would be very desirable. Such an arrangement would prevent the substantial damage that inevitably occurs when boxes of fruit are subjected to the constant battering they receive when the boxes are continuously shaken during transport.

Packaging fruit in this manner has long been recognized as being desirable, but heretofore there has been no way of doing this in an automatic, efficient, high speed, economical manner. Where honeycomb has previously been used, this has been done essentially by hand, and needless to say this is a slow method and a relatively costly procedure. Essentially, it has been accomplished by manually expanding a honeycomb material and holding the honeycomb in an expanded condition while the fruit is manually inserted. The industry has long been looking for a fully automatic damage preventing packaging system that is low in cost, operates at a high speed, and is relatively simple in design. The desired aim is to provide total internal protection for the product being packaged. That is to say, the article must be protected from pressures that would act to bruise or crush the product. A machine that could automatically package products in honeycomb capsules in a lost cost, high speed, efficient manner would be the answer to the industry's needs.

The advantage of using honeycomb material is that it provides a very strong configuration and has a very high strength-to-weight ratio compared to other products on the market. The origin of the term "honeycomb" is derived from the mass of hexagonal cells of wax built by honey bees and has become to mean a pattern resembling that of a honeycomb. The high column strength of honeycomb results in the loads being carried by the honeycomb material being distributed over a series of braced columns. It is this inherent structural geometry that makes honeycombs such desired material for use in packaging. The honeycomb cells act to isolate the articles disposed therein from adjacent articles. In the instant application, the honeycomb material is made up of a relatively high density Kraft paper, but it can, of course, be made of recycled paper, plastic, or other suitable materials.

The present invention is capable of accomplishing just what the packaging industry has been looking for. The machine embodying the present invention will automatically serve to load a box with multiple layers of fruit wherein each of the fruits will be encapsulated in its own cell and fully protected from damage by contact with other fruits in the container. To this end, a layer of fruit is placed into cells of an expanded honeycomb disposed on a separator sheet. The loaded honeycomb and separator sheet assembly is then placed in a container, such as, a shipping box.

An obvious advantage of using honeycomb structural packaging material, which along with a separator sheet fully encapsulates the article being packaged, is that it prevents crushing damage from above. This permits greater stacking height while substantially eliminating the possibility of damaging fruit contained in the bottom boxes of a stack of same.

Generally speaking, the following action takes place, although not necessarily in the sequence referred to. The following description is just intended to provide a narrative description of the operation that takes place. Specific details of the various components of the machine and the operations thereof will be set forth in a later description when discussing the drawings illustrating the invention.

The fruit to be boxed is placed in a described orientation on a carrier assembly which in the illustrated embodiment is designed to receive the requisite number of fruits, in this case apples, which will ultimately become a layer of fruit in a box. The layer of apples is initially located on the carrier in a location spaced from a loading station and is then moved into the loading station where it is to be deposited into cells of an expanded honeycomb structure. When the carrier assembly is first moved into a position adjacent the loading station, the apples are placed in a plurality of cup-shaped receptacles that are subsequently positioned to provide nesting, so the apples will be properly located in the honeycomb. The properly located apples are then moved into the loading station, where they are individually gripped and held in a cup assemblage in a raised position to permit the carrier on which the apples are located to be returned for receiving another layer of apples. During, or in any event, at or prior to the full raising of the apples off the carrier, an expanded honeycomb structural separator and a bottom separator sheet assembly previously deposited in an expander tray are located below the raised apples to receive them.

The formation of the expanded honeycomb will now be described.

The honeycomb separator for receiving the fruit is taken from a supply of compressed honeycomb and placed into an expander tray on top of a separator sheet placed there during an earlier operation. The honeycomb is expanded in the expander tray to open the cells for receiving fruit. The expander tray is pivotally mounted and when it receives the separator sheet it is located outside of the loading station and after the separator sheet is compressed, and subsequently expanded honeycomb is disposed therein, it is located in the loading station above the box to be loaded. After the carrier on which the apples are located has been removed from the loading station, the previously gripped and raised apples are lowered into the cells of the expanded honeycomb on top of the separator sheet. The assemblage of the fruit, expanded honeycomb and separator sheet is then raised by a vacuum assembly, after which the expander tray is moved out of the loading station. The assemblage is then free to be placed in a box disposed therebelow. After the first layer of fruit has been placed in the box, the series of steps will be repeated to place another layer of fruit into the box until it is filled. The filled box is then moved away and another box is placed in position and filled.

Various embodiments of the invention will now be seen by referring to the attached drawings, in which:

FIG. 1 is a perspective view illustrating the various components of the novel packaging machine;

FIG. 2 is a partial perspective view of the carriage assembly for introducing apples into the machine;

Figure 4:
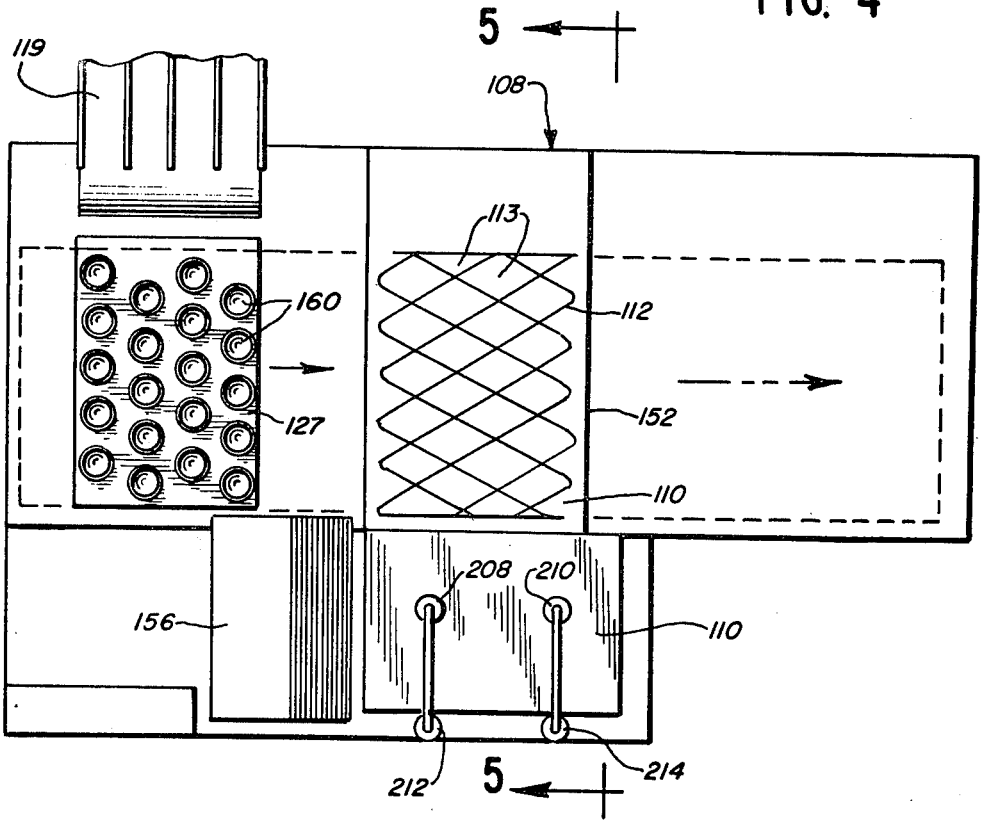
FIG. 4 is a schematic plan view showing the carrier for receiving the apples, the honeycomb expanded to receive apples, the honeycomb supply, and the separator sheet mechanism.
Figure 5:
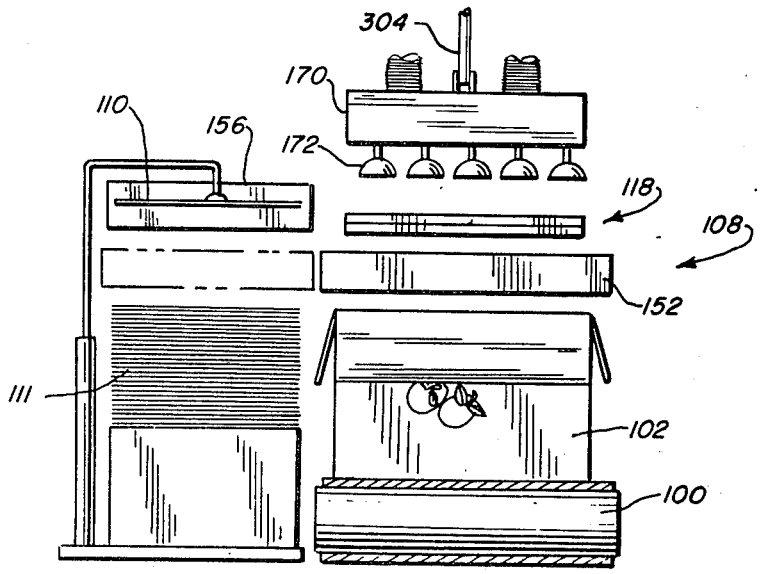
Figures 11, 12:
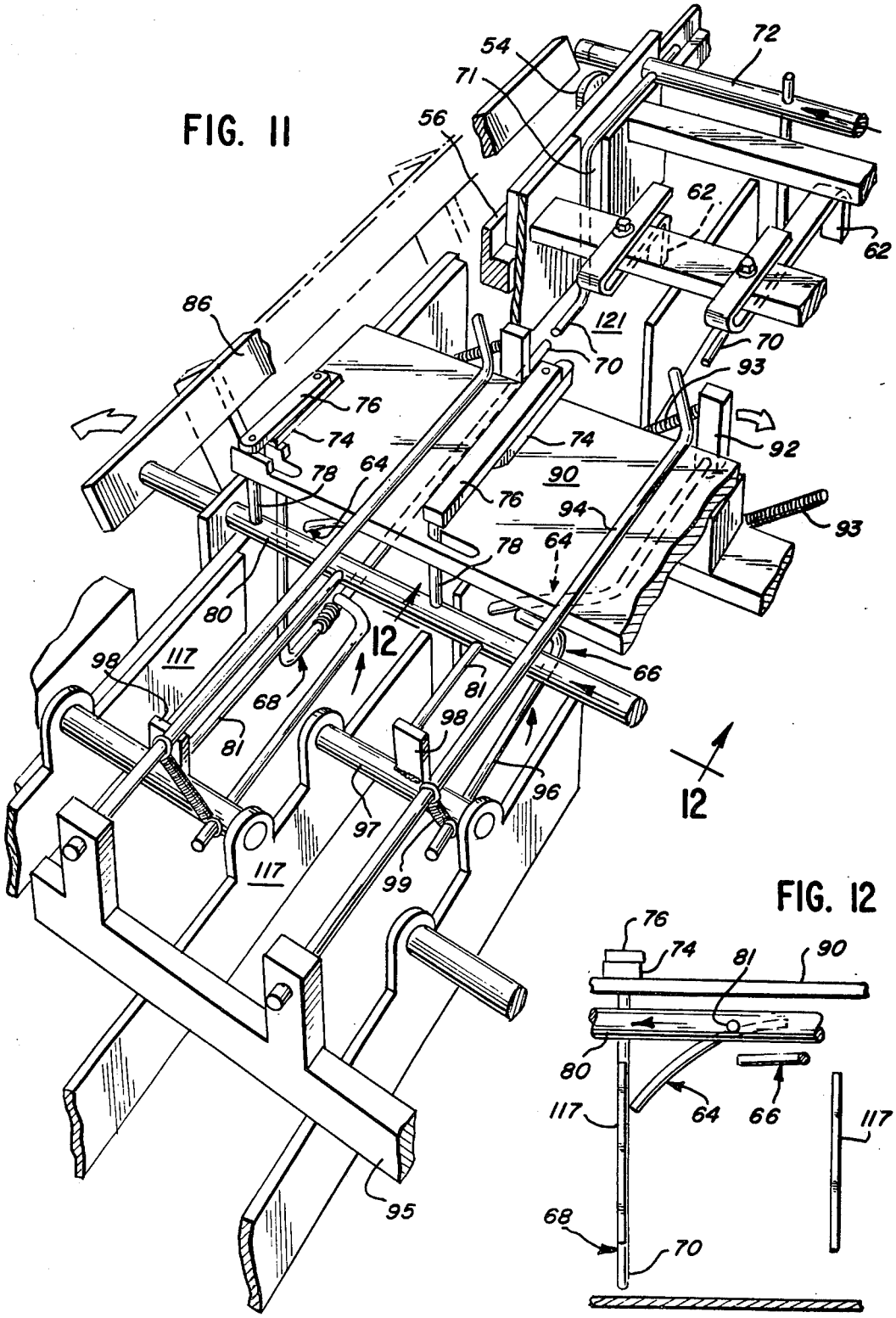
Figures 13, 14, 15:
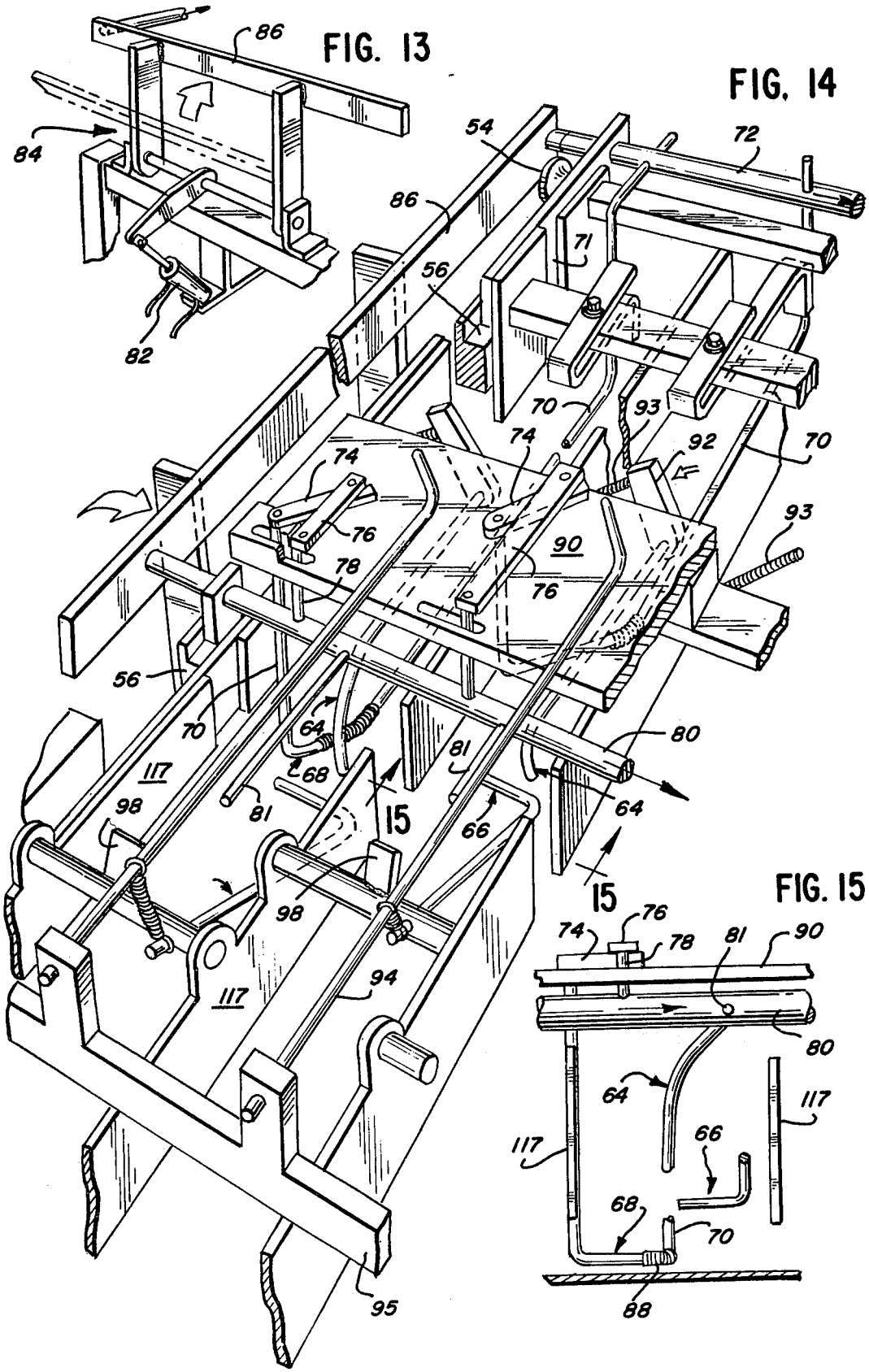
Figure 16:
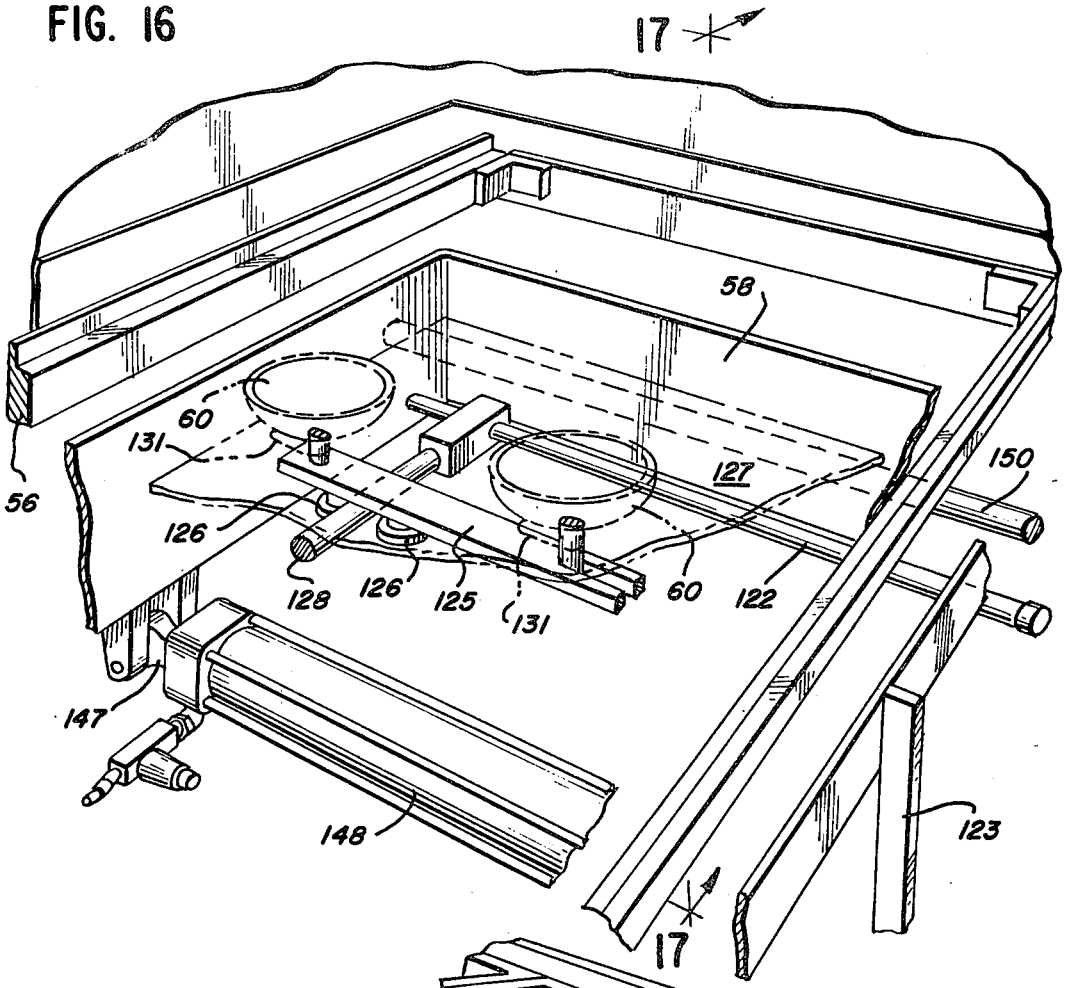
Figure 18:
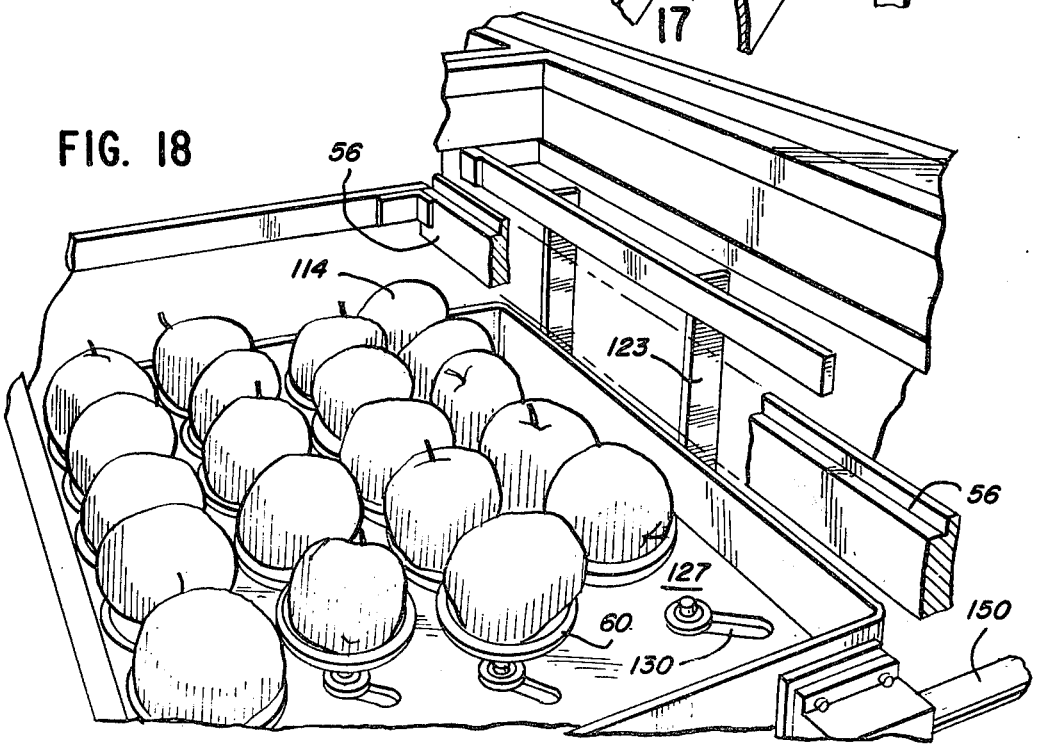
Figure 20:
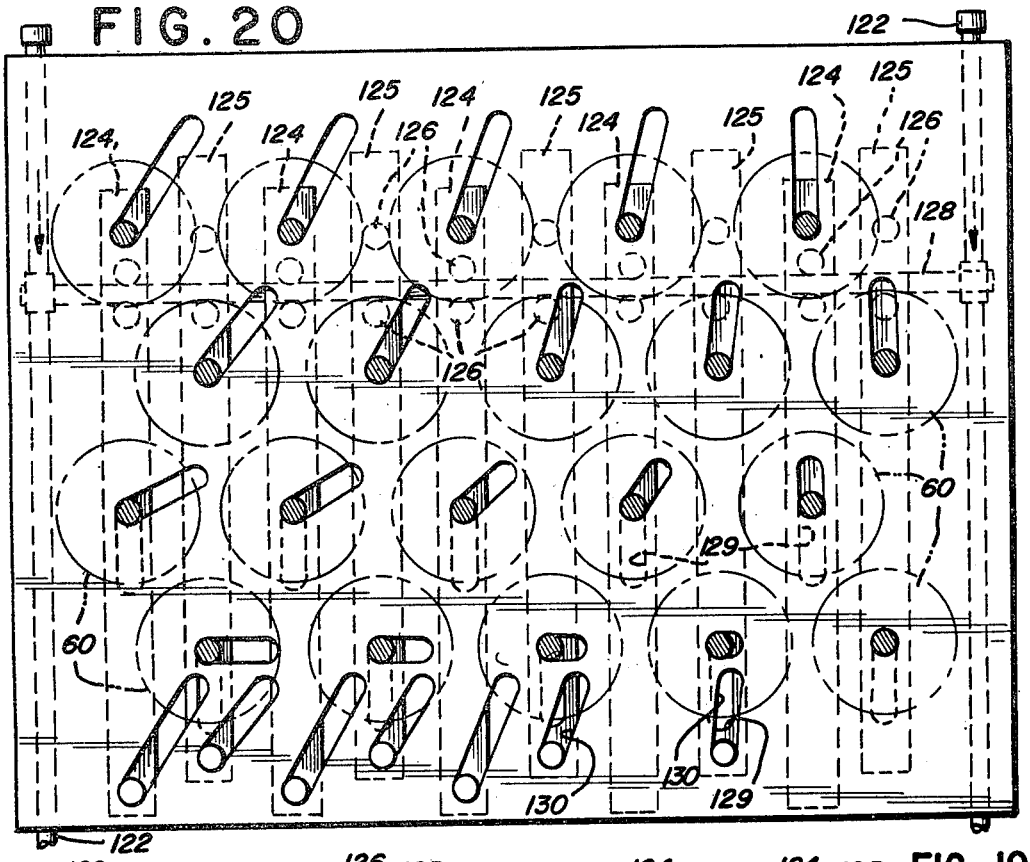
Figure 19:
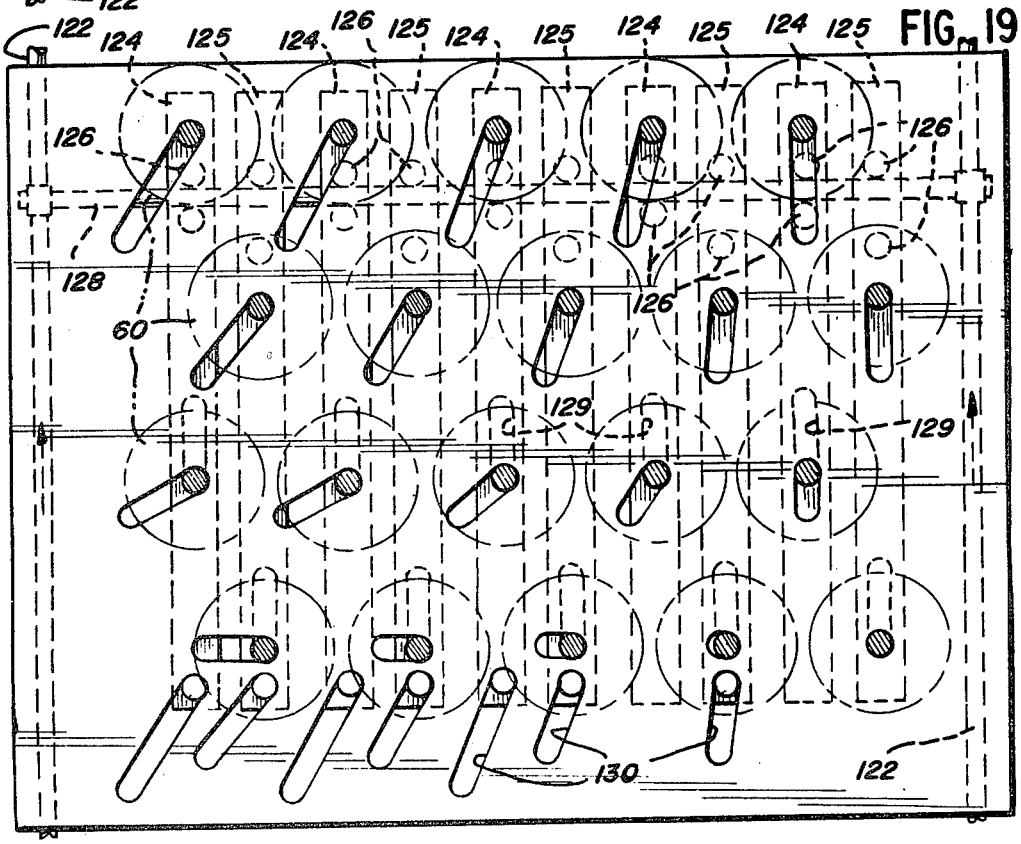
Figure 25:
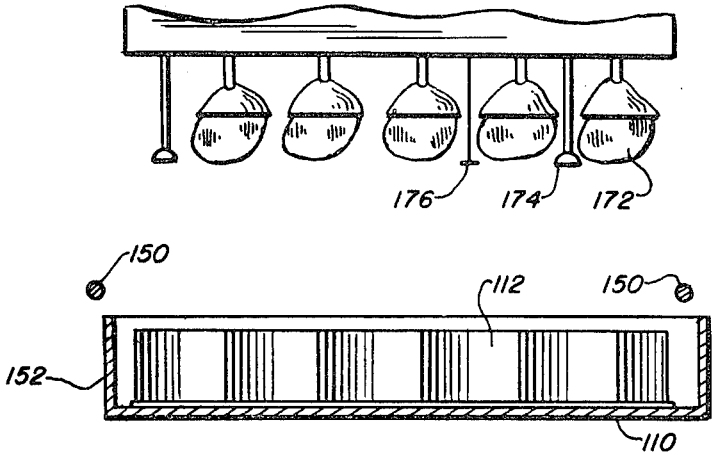
Figure 26:
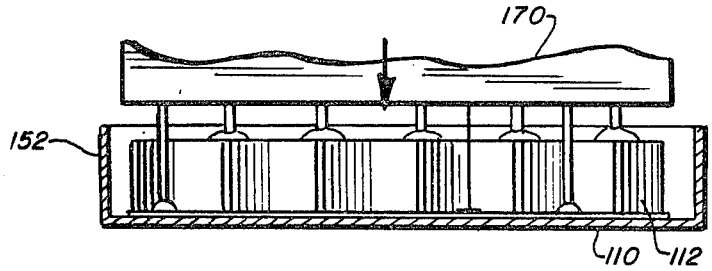
Figure 27:
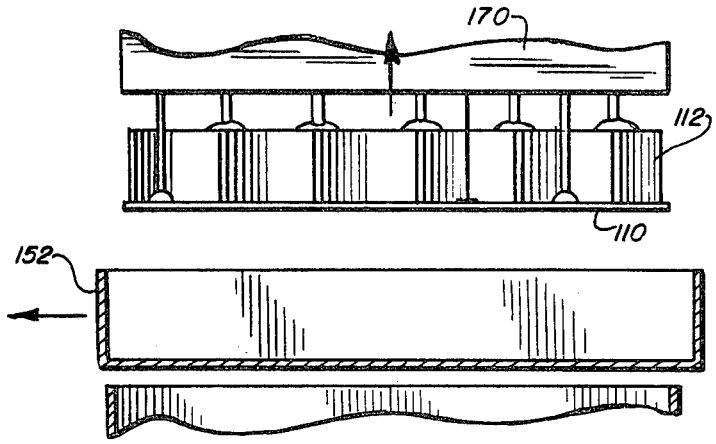
Figure 28:
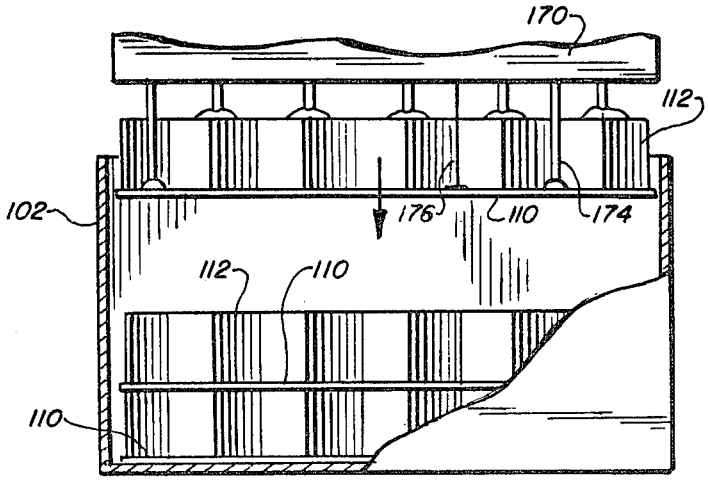
Figure 31:
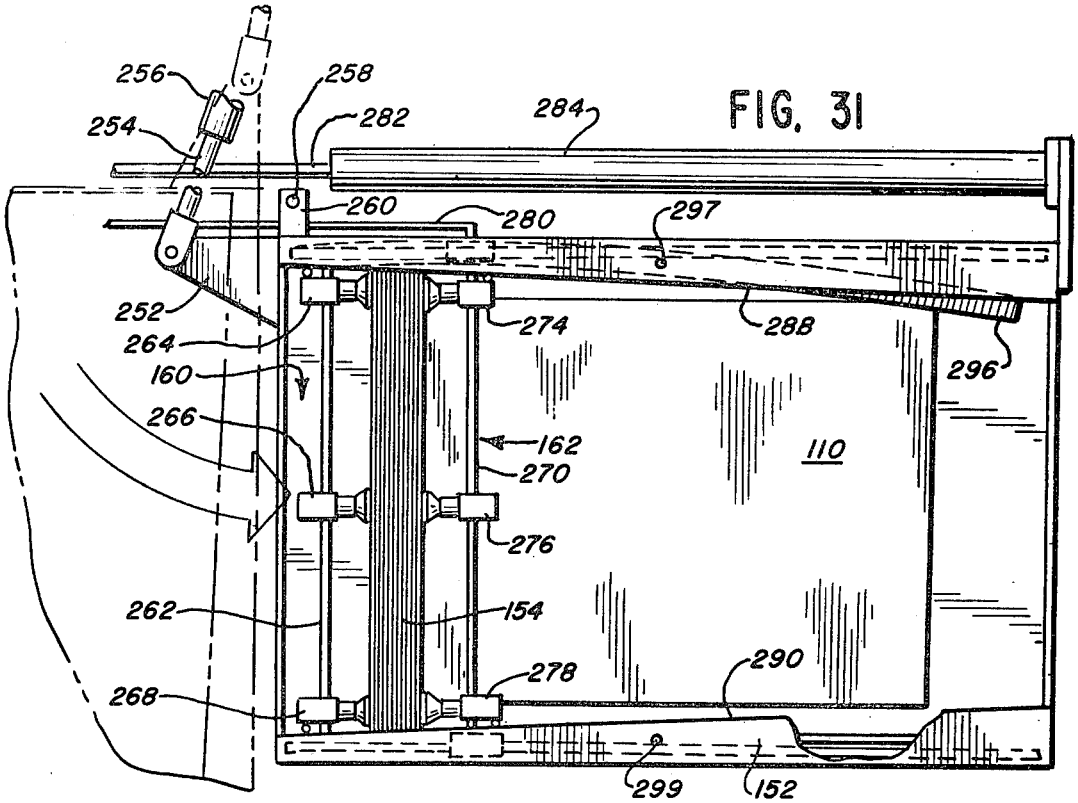
Figure 32:
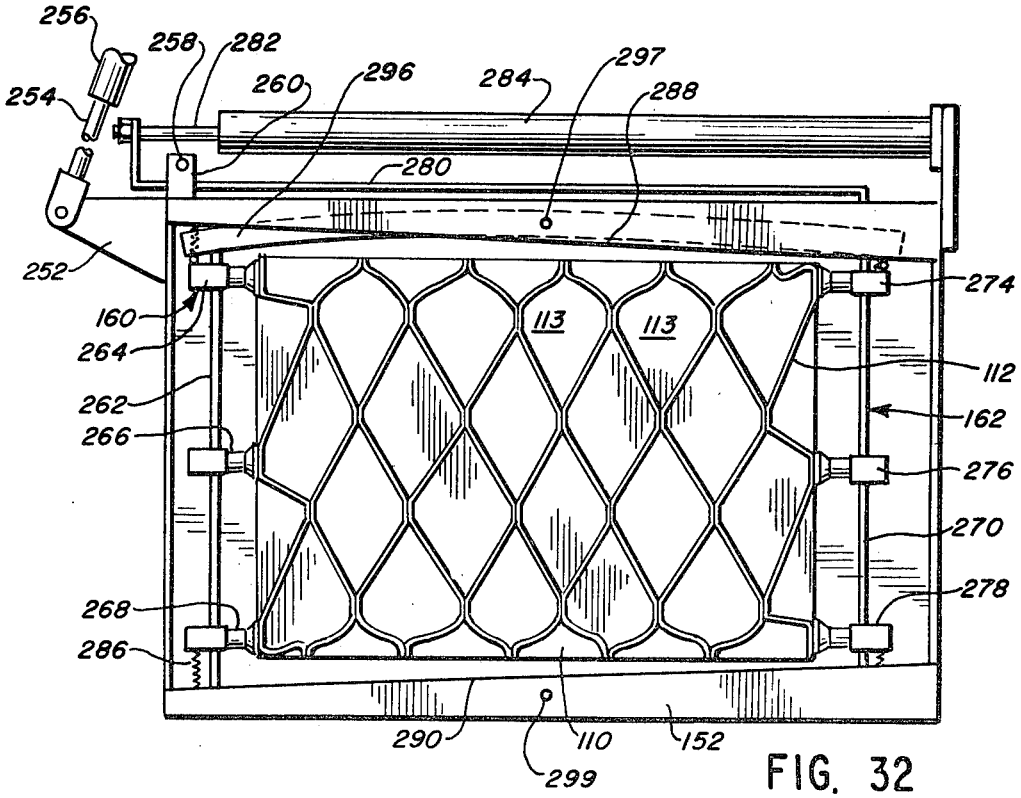
Figure 36A:
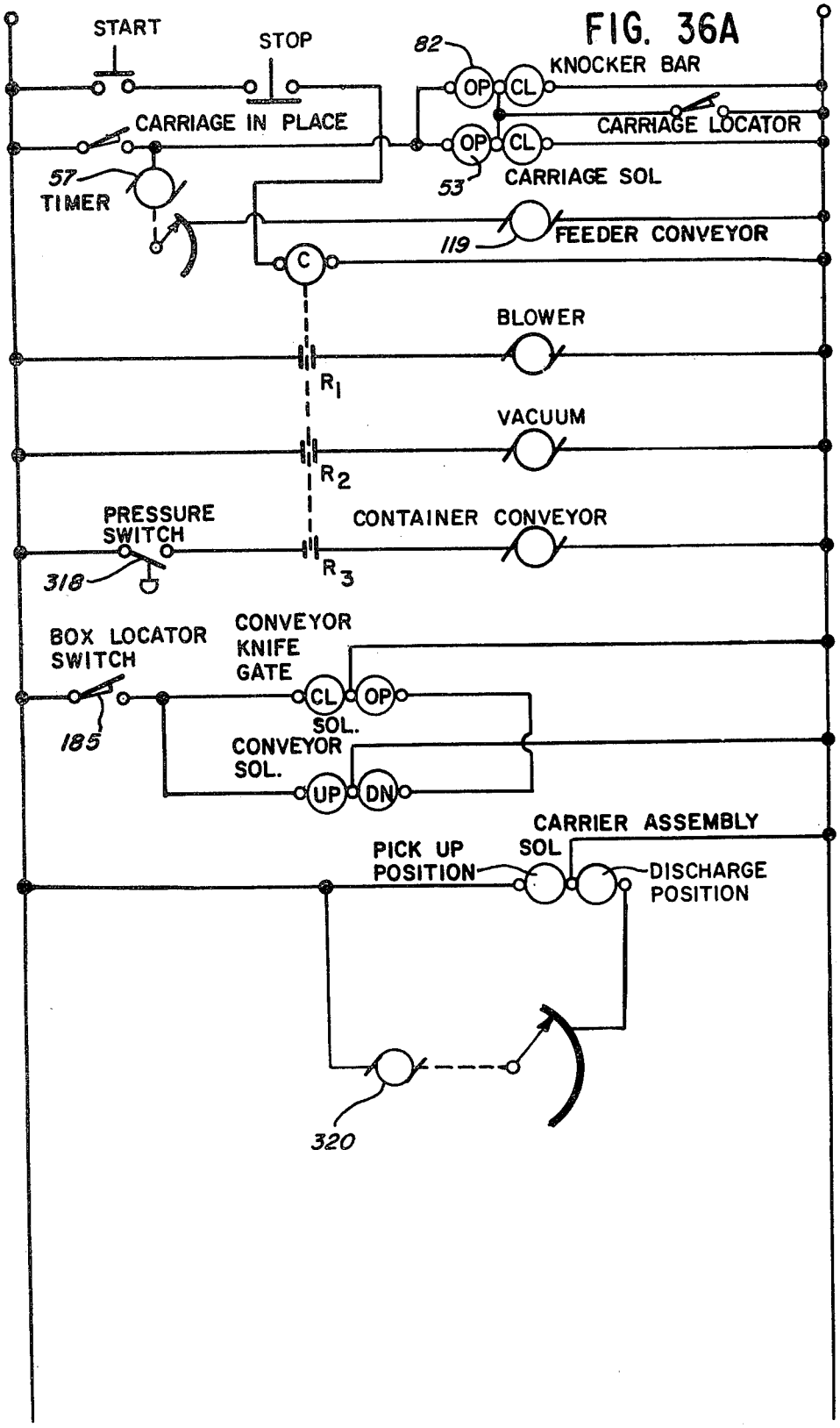

FIG. 5 is a side elevation view taken along line 5—5 of FIG. 4 illustrating the relative positions between the stack of separator sheets, the expander tray, shown both out of the loading station in broken lines and in the loading station in solid lines, and the various mechanisms disposed in the loading station, including the vertically movable vacuum housing assembly for raising and lowering the apples and honeycomb-separator assembly and also illustrating the position of the box to be loaded disposed on the conveyor;

FIG. 6 is a partial perspective view showing the apples in position to be introduced into the machine;

FIG. 7 is a partial perspective view showing the apples in the machine but prior to being dropped in the cup receiving box;

FIG. 8 is a partial perspective view showing the carriage assembly withdrawn and the apples deposited;

FIG. 9 is a partial perspective view showing the apples in the machine and another load in the carriage assembly on the infeed conveyor;

FIG. 10 is a partial perspective view similar to FIG. 6 with the cup receiving box retracted to receive another load of apples;

FIG. 11 is a perspective view, partially broken away, of the carriage assembly;

FIG. 12 is a partial end view of the assembly of FIG. 11 taken along line 12—12 of FIG. 11, with various components shown in the retracted position to receive apples;

FIG. 13 illustrates mechanism employed to operate the carriage assembly;

FIG. 14 is a view similar to FIG. 11 but illustrating the carriage assembly in condition to retain the apples therein for movement into the packaging machine;

FIG. 15 is a partial end view of the assembly of FIG. 14, taken along line 15—15 of FIG. 14, similar to FIG. 12, but with various components shown in the extended position to retain the apples in the carriage assembly as it is moved into the machine;

FIG. 16 is a partial perspective view of a portion of the cup receiving box;

FIG. 17 is a cross-section view looking into the direction of arrows 17—17 in FIG. 16 illustrating mechanism for adjusting the position of the cups within the box;

FIG. 18 is a partial perspective view of the cup receiving box with the apples in place;

FIG. 19 is a plan perspective view of the cups in position to receive the apples from the carriage assembly;

FIG. 20 is a view similar to FIG. 19, but showing the cups moved to a nested position for proper location in the honeycomb;

FIG. 21 shows apples in position in the cup receiving box;

FIG. 22 shows the apples in the loading station just prior to being contacted by the vacuum housing assembly used to raise the apples, so the apple carrier can be moved back to receive a subsequent load of apples;

FIG. 23 is similar to FIG. 22 but shows the cups of the vacuum housing assembly in contact with the apples;

FIG. 24 shows the apples being raised upwardly away from the apple carrier and with the expanded tray in on which there is a separator sheet and expanded honeycomb located in the loading station for receiving the apples;

FIG. 25 is a view similar to FIG. 24 with the apple carrier removed from the loading station;

FIG. 26 is a view in which the vacuum housing is lowered and the apples returned and loaded into the honeycomb;

FIG. 27 illustrates the vacuum housing raised and carrying along with it the separator sheet, expanded honeycomb, and loaded apples to retract the honeycomb and separator sheet out of the expander tray;

FIG. 28 shows the separator sheet, expanded honeycomb and apples being dropped into a shipping box after the expander tray has been removed;

FIG. 29 shows the guillotine assembly for removing sections of compressed honeycomb to be expanded into the expander tray;

FIG. 30 is a perspective view partially broken away showing the various mechanisms employed in expanding the honeycomb in the expander tray;

FIG. 31 shows the expander tray that has just received the compressed honeycomb prior to the expanding of the honeycomb;

FIG. 32 is a view similar to FIG. 31 showing the honeycomb in the expanded condition;

FIG. 33 is a perspective view showing the mechanism for controlling the flow of air relative to the vacuum housing assembly;

FIGS. 34 and 35 are views showing two positions of the valve mechanism for controlling the flow of air to the vacuum housing assembly;

FIGS. 36A and 36B illustrate the circuit diagram describing in schematic form the operation and timing sequence of various components of the machine;

FIG. 37 illustrates a mechanism for mechanically gripping the fruit with the mechanism opened to circumscribe an item; and FIG. 38 illustrates the mechanism shown in FIG. 37 in the fruit engaging position.

Before describing the apparatus in any substantial detail, it is felt that it would be desirable to describe the series of steps that take place in the operation of the novel packaging machine in conjunction with a general description of the major components contained in the machine. With this understanding, the later description of the specific mechanisms of the machine will be better understood.

FIG. 1 is an overall perspective of the packaging machine 50 illustrating the direction of movement of the boxes 102 to be filled on a conveyor assembly 100 passing through the machine and the apples 114 to be disposed therein. The apple loading carriage assembly 52 is shown in enlarged detail in FIG. 2 and also in FIG. 2 a load of apples is shown in the apple carrier assembly 118 before it is moved into the loading station 108 of the machine 50 where it is placed in the honeycomb and finally into the shipping boxes.

Figure 3:
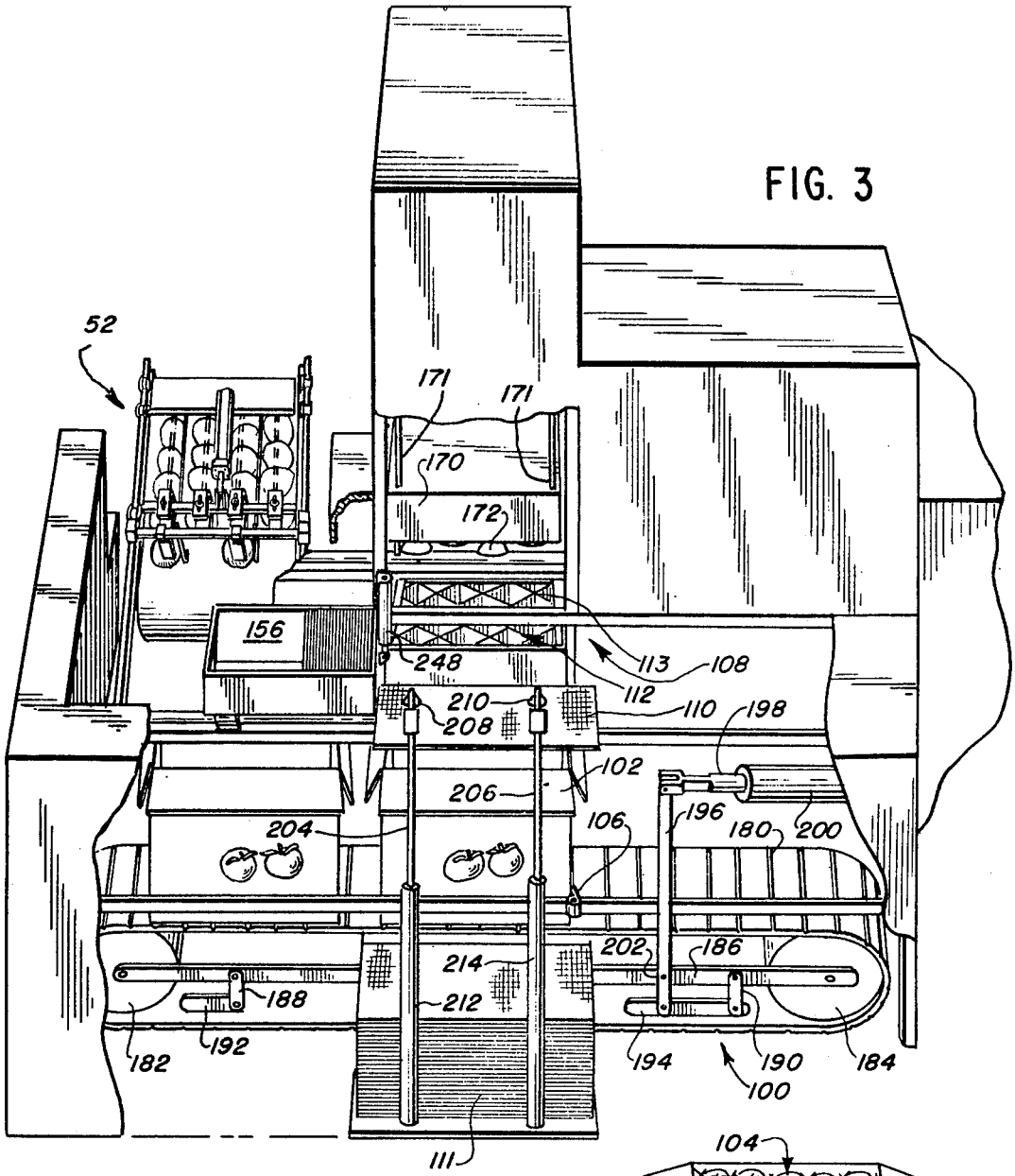
FIG. 3 is a perspective view, partially broken away, illustrating the various components of the novel packaging machine.
Figure 3A:
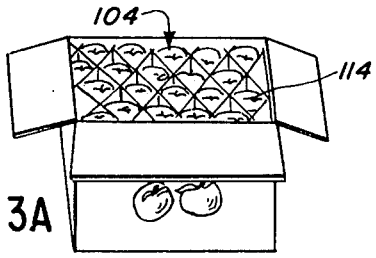
FIG. 3A is a perspective view of a loaded box of fruit to be shipped.

Referring now to FIG. 3, there is illustrated a conveyor assembly 100 on which there are located a series of shipping boxes 102 into which layers of fruit 104 (see FIG. 3A) are to be placed. The boxes 102 are located on the conveyor 100 and the conveyor 100 is operated until an empty box 102 engages knife gate stop mechanism 106 which accurately positions a box 102 in what will be generally referred to as the loading station 108. It is at this station that a separator sheet 110, expanded honeycomb 112, and fruits, in this case apples 114, to be located in the cells 113 of the expanded honeycomb 112 are placed in the box 102. The honeycomb has a greater height than the apples to be received, so the apples are fully encapsulated. The requisite layers of fruit 104 are placed in the box until it is full.

Referring now to the left-hand portion of the machine, and also in FIG. 2, there is shown a quantity of apples 114 from which a prescribed number is taken to form a layer of fruit 104 to be ultimately disposed into the box 102.

Referring now to FIGS. 6–9, there is schematically illustrated the sequence of steps that take place in order to locate a layer of apples in the loading station where the apples are removed from the apple carrier assembly and ultimately boxed. The specifics of the apple loading and feeding system are set forth in the section entitled "Apple Loading and Feeding System," but a brief understanding is important at this stage in order to obtain a general overview of how the novel packaging machine works.

As shown in FIG. 2, the apples are directed down chutes 116 formed between spaced longitudinally extending plates 117. The apples are directed into the chutes by a belt conveyor 119 driven in a conventional manner. The end section 121 of the chutes 116 form part of the apple feeding carriage assembly 52 that moves into and out of the machine in the manner shown in FIGS. 7 and 8. After the apples have been directed into the chutes against suitably positioned end stops, the apples in the chute section 121 are retained therein by a bottom support and end stops shown in detail in FIGS. 11, 12, 14 and 15. When the supports and end stops are in position, the chute section 121 and apples disposed therein can be moved off of the conveyor 119. The apples remaining in the chutes 116 will be retained therein by additional stop means that will move in front of the apples when the feeding carriage moves into the machine.

The apple feeding carriage assembly 52 includes rollers 54 that move on tracks 56 (see FIG. 11) into and out of the machine. The carriage is moved into and out of the machine by the cylinder assembly 53. Referring again to FIG. 6, the feeding carriage is shown outside of the machine and at an elevation above the carrier assembly 118 that is to receive the apples from the feeding carriage and subsequently move them into the machine. The carrier assembly includes a tray containing a plurality of cups 60 which are positioned to receive the apples from the chute section 121. After the apples 114 are dropped into the cups 60, the feeding carriage is moved out of the machine as shown in FIG. 8 and the carrier assembly 118 is moved into the loading station 108, as shown in FIG. 9. During this time, the feeding carriage is being refilled to reload the carrier assembly when it returns to the position shown in FIG. 10.

The aforementioned nesting of the cups 60 takes place when the carrier assembly 118 is moved by the piston rod 147 actuated by cylinder 148 into position into the loading station 108 along guide rods 150.

With the apples in the loading station on the apple carrier assembly 118, a mechanism must be provided to introduce the expanded honeycomb 112 into the loading station 108 to receive the apples.

We will now turn to the description of the mechanism which provides for the location of expanded honeycomb disposed above a separator sheet in an expander tray 152 in the loading station to receive the apples from the apple carrier assembly.

Referring first to FIG. 5, there is illustrated a separator sheet 110 being taken from a stack of sheets 111 located adjacent to the box 102 and raised upwardly a sufficient amount to permit an expander tray 152 to be pivoted to the broken line position shown in FIG. 5 outwardly of the loading station and below the separator sheet 110. With the expander tray 152 in this position, the separator sheet 110 is lowered into the expander tray 152. After the separator sheet has been placed on the bottom of the tray 152, a section 154 of compressed honeycomb from a honeycomb tray 156 is pushed into the expander tray 152 by a guillotine knife 158 as shown in FIG. 29.

The section 154 of compressed honeycomb resting above a separator sheet 110 is then gripped by suction cup assemblies 160,162 to expand the honeycomb to the fully open position, as shown in FIG. 32. The expander tray 152 with the expanded honeycomb is pivotally moved into position inside the loading station 108.

From the above description, in the loading station, there is now located the apple carrier assembly 118 containing apples and immediately therebelow is the expander tray 152 containing the expanded honeycomb 112, and below the expander tray is located the box 102 to be loaded with a layer of fruit. The schematic representation of the above minus the apples is shown at the right-hand side of FIG. 5.

With the above in mind, the sequence of steps shown in FIGS. 22 and 28 takes place. That is to say that initially, and as shown in FIG. 22, the vacuum housing assembly 170 is lowered by a mechanism described in detail hereinafter until the cups 172 engage the apples 114, as shown in FIG. 23. There are as many cups 172 provided as there are apples and they are designed and located to contact the apples. When this occurs, the air flow through the cups into the vacuum box results in a pressure differential (a venturi effect) acting to maintain the apples in position relative to the cups 172. Note the flow pattern in FIG. 33. The vacuum housing 170 has a pressure sensor switch 176 depending therefrom, which is designed so that when it engages cover plate 127 it will act to raise the vacuum housing to lift the apples in the manner shown in FIG. 24. Following this, the apple carrier assembly 118 is moved out of the loading station and filled with another layer of apples.

As the carrier assembly is moved out of the loading station, the vacuum housing reaches the top of its travel and engages a switch (not shown) after which it again moves downwardly. With the apple carrier assembly 118 removed, it can be seen that the lowering of the vacuum housing 170 will then place the apples into the expanded honeycomb 112. When this occurs, suction cups 174 engage the separator sheet 110 at the same time that the pressure sensor switch 176 engages the separator sheet, with the result that this reverses the action of the vacuum housing 170, and the vacuum housing is again raised upwardly. During this operation, the suction cups 174 will carry with them the separator sheet and expander tray 152 in the manner as shown in FIG. 27. With the raising of the separator sheet, honeycomb and apples from the expander tray, the expander tray is moved out of the loading station. After this, the vacuum housing is lowered until it drops the layer of fruit disposed on the separator sheet into the box as shown in FIG. 28.

The above general description of the various components of the machine provides a very good understanding of the overall apparatus and will be of assistance when considering the following detailed description of the various mechanisms of the packaging machine.

Each section of the machine will now be specifically described in detail.

I. CONVEYOR SYSTEM

Referring to the bottom part of FIG. 3, there is located the conveyor assembly 100 that is provided to convey the boxes 102 into position in the loading station 108 and after they are filled to move them out of the loading station and replace the filled one with an empty box. It is desired that once a box is in the loading station, it be raised upwardly to fit closely within the loading station. To this end, the conveyor assembly 100 is designed to be moved between a raised and lowered position.

The illustrated conveyor assembly, which is by way of example only, consists of an endless belt 180 that moves around two drums 182, 184, one of which is driven by a motor, not shown. When the conveyor is started by a switch, a box is moved until it hits a box locator switch 185 (see electric circuit diagram), at which time it actuates a conveyor knife gate stop mechanism 106 to fix the box in position.

For raising and lowering the conveyor, there is shown a simple linkage assembly which is by way of example only since various suitable arrangements can be employed. The two drums 182, 184 are interconnected by an elongated link 186, which when raised will raise the conveyor assembly. The elongated link 186 is connected to the tops of a pair of movable links 188, 190 located adjacent drums 182, 184, respectively. The bottom of these links 188, 190 are pivotally connected to fixed links 192, 194 that are secured to a frame member, not shown. For moving the elongated link 186 and thus the conveyor assembly between the upper and lower positions, there is provided a lever 196 that is secured at one end to fixed link 194 and at its other end to rod 198 extending outwardly from cylinder 200 and at an intermediate point adjacent to the link 194 by a pivot pin 202 to the elongated link 186. In the position shown in FIG. 3, the conveyor is shown in the raised position and movement of the rod 198 to the left by actuation of the cylinder 200 will result in the downward movement of elongated link 186, with the result that the conveyor assembly 100 will be moved downwardly. Reverse movement of the rod 198 will raise the conveyor.

II. APPLE LOADING AND FEEDING SYSTEM

Reference will now be made to the apple loading and feeding system, including the feeding carriage and the carrier assembly and the mechanism for moving the feeding carriage relative to the carrier assembly and the carrier assembly into and out of the loading station.

The apple loading and feeding system is illustrated in FIGS. 2 and 6–20.

Referring first to FIG. 2, there is illustrated a perspective view of the feeding carriage including the apple guide chutes 116 and a portion of the apple carrier assembly shown loaded with apples for movement into the loading station.

As previously discussed, FIGS. 6 through 10 are schematic representations of the feeding carriage shown in various positions relative to carrier assembly and the carrier assembly located in the loading station for depositing apples into honeycomb and then boxing same. Also mentioned briefly was that the carriage had to include various mechanisms for retaining the apples in the chute section 121 associated with the carriage when the carriage is moved off of the conveyor into the machine for depositing the apples in the carrier assembly.

While the carriage assembly 52 is shown in FIG. 2, in perspective, a better understanding of the carriage assembly can be had by referring to FIGS. 11, 12, 14, and 15. As shown in FIG. 2, there are illustrated rows of apples in the carriage assembly, as well as apples disposed on cups in the cup receiving tray portion 58 of the carrier assembly.

As previously mentioned, the apples are fed into the carrier assembly by the conveyor 119 and they move against stops 62 located at the end of the carriage. The adjacent end stops 62 are in stepped relationship so that when the carriage is moved into the machine over the carrier assembly, the apple rows will be properly staggered so that when the apples are released from the carriage, they will be accurately deposited on the cups 60 of the carrier assembly.

Movement of the apples into the carriage assembly is permitted when the various mechanisms forming parts of the carriage are in the position shown in FIGS. 11 and 12. That is, the end stops 64, 66 provided for preventing apple movement out of the carriage after it is loaded and into the carriage and out of the chutes after the carriage is loaded, respectively, and a bottom support 68 for the apples when they are in the carriage are all located out of the apple path as shown in FIG. 12. Following the loading of the carriage, the bottom support 68 and the end stops 64, 66 should be moved to the position shown in FIG. 15, wherein the apples located in the carriage 52 will be retained therein and thus when the carriage 52 is moved off of the conveyor into the cup receiving tray 58, the apples will stay in the preset position in the carriage assembly.

Turning now specifically to FIGS. 11 and 12, it is seen that the mechanisms for retaining the apples in position in the various rows are located out of position, so that there is no impediment to the apples being placed in the rows. It can be appreciated that for the carriage to positively carry the apples into the machine, the apples must be held against moving out the bottom and the open end of the chute section and end stops must be provided to hold the apples located in the chute sections behind the carriage when the carriage is moved forward into the packaging machine.

We will refer first to details of the bottom support mechanism 68 for preventing the apples from moving out of the bottom of the carriage 52 as applied to a single row of apples. It is to be understood that these are duplicated for each of the rows.

As can be seen from FIGS. 11 and 12, the bottom apple support 68 consists of an elongated generally U-shaped rod 70 that is in the vertical position located in grooves 71 and thus out of the way of the apples as they are introduced into the chute sections 121 of the carriage assembly. This rod is connected at its far end to a transversely movable push rod 72, and at its near end to a link 74 that is connected to a second link 76, and link 76 is in turn connected to a pin 78 that is affixed to a transversely movable push rod 80. At the prescribed time sequence before the carriage is moved into the machine, a cylinder 82 (see FIG. 13) is actuated which through a mechanism 84 pivots a plate 86 that engages rods 72 and 80 to move them to the position shown in FIG. 14 which through the links 74 and 76 the rod 70 is moved to the position shown in FIG. 15, where it underlies the apples above the conveyor 119. The rod 70 has intermediate its longitudinal portion thereof a flexible spring connection 88 which thus permits the rod 70 when pivoted by link 74 to be moved to the position shown in FIG. 15.

The carriage 52 which moves on rollers 54 on tracks 56 includes plate 90 which rotatably supports the end stops 64 that act to prevent the apples from moving out of the chute sections 121 when the carriage assembly 52 is moved into the machine. The end stops 64 include a bracket 92 that is cammed into the position shown in FIG. 11 against the action of a tension spring 93 by the fixed rod 94 that is connected to a frame member 95. Thus, with the carriage assembly in the retracted position as shown in FIG. 11, the end stop 64 is held out of the way of incoming apples (see FIG. 12). When the carriage starts its movement into the machine, the bracket disengages from the rod 94 and the spring 93 pivots the end stop downwardly to the position shown in FIGS. 14 and 15.

It can be appreciated that when the chute sections 121 are moved by the carriage assembly 52 into the machine some provision must be made to prevent the apples in the chutes 116 behind the sections 121 from moving forward on the conveyor since if that occurs they will just fall off onto the floor. To this end, upon forward movement of the carriage 52, a barricade must drop down in front of the rows of apples to perform this function. The end stops 66 employed in each row consist of an L-shaped rod 96 that is rotatably mounted in a pin 97 that is rotatably supported between plates forming a chute section. Located intermediate the ends of the pin 97 and extending outwardly therefrom is a bracket 98 welded thereto. The free end of the rod 96 adjacent the pin is interconnected to rod 96 by a tension spring 99 that normally acts to rotate the pin 97 and rod 96 downwardly to where the leg of the rod 96 blocks movement of apples out of the chutes 116 as shown in FIGS. 14 and 15. However, when the carriage assembly is receiving apples, rod 96 is moved to the positions shown in FIGS. 11 and 12 by pin 81 that extends from the push rod 80 and contacts the bracket 98 to rotate the pin 97 and move rod 96 upwardly to the unblocked position.

When the carriage assembly 52 is loaded, it is moved into the machine above the carrier assembly 118 by the piston rod part of the cylinder assembly 53 shown in FIG. 2. When the carriage assembly is in the machine, the apples contained therein are located over the cups 60 in the carrier assembly 118 when assembly 118 is in the position shown in FIG. 7. When the carrier assembly is located as shown in FIG. 7, freely slidable bars 122 located therein engage one end of a pivoted lever 123 (see FIG. 17) and the other end thereof engages the rods 72 and 80 to move them back to the position shown in FIGS. 11 and 12, which moves the bottom support rod to the vertical position shown in FIG. 12, whereby the apples are free to fall out of the carriage assembly 52 into the cups 60. The tension spring 115 acts to keep the lever 123 out of engagement with rods 72 and 80 until contacted by bars 122.

The location of the cups 60 relative to the apples 114 in the carriage assembly is such that there is no problem with respect to the apples being received from the carriage assembly. However, it can be appreciated that the honeycomb construction for the apples essentially consists of a plurality of nested compartments and thus in order for the position of the apples in the carrier assembly to conform to the honeycomb configuration the cups have to be moved after they have received the apples to a nested position comparable to the honeycomb pattern, so that when the apples are taken from the cups and the cups removed, the apples can then be dropped cleanly into the honeycomb compartments.

The mechanisms for employing this are best shown in FIGS. 16–20, and essentially, the cups are initially positioned in an unnested position for receiving apples from the carriage, as shown in FIG. 19, and are subsequently moved through mechanisms to be described to that shown in FIG. 20 where they are properly located for the apples to be transferred from the cups to the honeycomb.

By way of example, there are illustrated four rows of cups with the first and third rows being secured to bars 124 and the second and fourth rows being secured to bars 125. Extending beneath the bars 124, 125 are affixed cylindrical stops 126 that are contacted to adjust the position of the bars 124, 125. The positions of these bars are controlled by crossbar 128 that is moved by slider bars 122 to engage the stops 126. The cups 60 extend through slots in the top plate 127 of the carrier assembly 118 and thus normally move with the carrier assembly until the slider bars 122 engage a barrier located within the loading station, at which time the cups will be moved by the slider bars 122 and connected crossbar 128, as determined by the stops 126. Looking first at FIG. 19, the carrier assembly is in the position shown in FIGS. 7 and 17, with the slider bars and crossbar moved to contact the upper row of stops 126. In this position, the bars 124 and 125 are in alignment and the cups are positioned to receive apples from the carriage assembly. When the carrier assembly is in the loading station 108, the slider bars 122 are again contacted and the crossbars move the bars 124, 125 to the position illustrated in FIG. 20 at which time the cups 60 are properly nested. The slots 131 in the top plate 127, as well as the slots 129 in the bars and the end slots 130 are provided to insure that the bars 124, 125 are permitted sufficient longitudinal and lateral (parallelogram) movement to be able to move the cups 60 between the prescribed positions required to pick up the apples from the carriage assembly and subsequently deposit them into a honeycomb. As shown in FIG. 17, the cups are slidably mounted relative to the top plate 127 and the bars 124 and 125 to effectuate proper movement.

Now that the apples are placed in the loading station, attention is directed to FIGS. 3, 4, 5, and 29, which illustrate the mechanism for providing the expander tray 152 with a separator sheet 110 and a section 154 of compressed honeycomb, when the expander tray is located outside of the loading station in the broken line position shown in FIG. 5.

III. SEPARATOR SHEET ASSEMBLY

The separator sheets 110 that are provided to separate the rows of expanded honeycomb and provide a bottom for the fruit placed in the honeycomb cells are located in a stack 111 immediately adjacent to the conveyor assembly 100. The separator sheets are individually raised to the position shown in FIG. 5 by a pair of vacuum cups 208, 210 located on the end of arms connected to the piston rod assemblies 204, 206 operated by the cylinders 212, 214. Suction is provided to the cups in a conventional manner, not shown. The cylinders 212, 214 are operated in the desired sequence so that the cups 208, 210 act to grip the top separator sheet 110 and lift it into the raised position to await the location of the expander tray 152 which is moved thereunder to receive the separator sheet 110. When the expander tray 152 is in position, the suction is released and the separator sheet drops into the bottom of the expander tray.

IV. HONEYCOMB SUPPLY

Referring now to FIG. 29, there is shown a tray 156 holding sections of compressed honeycomb 154. A pre-cut section 154 of the honeycomb is forced out of the tray 156 by a guillotine knife 158 secured to a bracket 242 that is slidably mounted in a slot 244 of a frame plate 246. A cylinder assembly 248 also secured to the frame plate 246 includes an extending piston rod 250 that is connected to the bracket 242. In the proper sequence, which will be discussed later when describing the electrical circuitry, the rod 250 is lowered to move the knife 158 downwardly to force a section of compressed honeycomb 154 into the expander tray 152. The compressed honeycomb section 154 has been preformed and cut to provide the desired configuration.

V. EXPANDER TRAY ASSEMBLY

The expander tray assembly 152 is designed to receive a separator sheet 110 on the bottom thereof and a section of compressed honeycomb 154, which honeycomb 154 is expanded in the expander tray assembly to provide the open cells 113 for receiving apples. As previously mentioned, the expander tray receives the separator sheet and the compressed honeycomb when in the broken line position shown in FIG. 5 outside of the loading station 108. Details of the expander tray assembly are best seen by referring to FIGS. 31, 30, and 32, in which FIG. 31 shows the expander tray being pivoted into position in the loading station and FIG. 32 shows the compressed honeycomb in the expanded condition. FIG. 30 is a perspective view partially broken away showing the various mechanisms located within the expander tray that are provided in order to expand the honeycomb to its open cell position.

The expander tray includes a triangularly shaped bracket 252 at one end thereof, the end of which is connected to the piston rod 254 of a cylinder assembly 256, which piston rod 254 when extended moves the expander tray from the broken line position shown in FIGS. 5 and 31 into the solid line position shown in FIGS. 31 and 32. The expander tray is pivoted about a pin 258 which is connected to a bracket 260 extending from one end of the expander tray.

The compressed honeycomb is initially located in the expander tray as shown in FIG. 31 and is maintained in the position shown in FIG. 31 by a plurality of suction cup assemblies 160, 162. These assemblies consist of a fixed rod 262 having located thereon three suction cups 264, 266, 268, which abut the left-hand end of the compressed honeycomb section 154 and a longitudinally movable rod 270 having three suction cup assemblies 274, 276, 278 engaging the right-hand side of the honeycomb. Essentially, the right-hand rod 270 is moved to the right to the position shown in FIG. 32 to effectuate expansion of the compressed honeycomb into the open cell position. A pure linear movement of the suction cups will not attain the desired result, since, as can be appreciated, when the honeycomb is expanded, its width is reduced and compensation must be made during this expansion process. To this end, it is necessary that suction cups 264, 268 and 274, 278 mounted on the outer ends of the rods 262, 270, respectively, must be moved inwardly during the expansion process. It remains to note before describing this mechanism that suction is provided to the cups in a conventional manner and the details of this are not important to an understanding of the present invention. Also, the movement of the rod 270 to the right is accomplished in the illustrated embodiment by connecting the movable rod 270 to a rod 280 that is connected at its opposite end to the piston rod 282 of the cylinder assembly 284. In the compressed condition of the honeycomb, the piston rod 282 extends outwardly to the left and when it is retracted by the cylinder assembly 284, it will act to move the rod 270 to the right to expand the honeycomb to the configuration shown in FIG. 32.

Before describing the specific mechanism of effecting the inward movement of the outward disposed cups located on the rods 262, 270, it is to be noted, as shown in FIG. 30, that the cups are biased to their outwardmost position by tension springs 286. Also, it is noted that the center suction cups 266, 276 of both rods 262, 270 are fixed, and no provision need be made for transverse movement of these cups.

To effectuate movement of the outermost suction cups 274, 278 on the rod 270, the expander tray 152 is provided on its upper surface with oppositely disposed cam surfaces 288,290 which are tapered toward the center of the tray. The cup assemblies 274, 278 have pins 292, 294 which extend upwardly therefrom and contact the cam surfaces 288, 290 so therefore longitudinal movement of the rod 270 will result in the cam surfaces 288, 290 forcing the suction cups 274, 278 inwardly as the honeycomb is expanded.

In order that the suction cup assemblies 264, 268 located on the fixed rod 262 are also moved inwardly in the prescribed manner, pivotally mounted curved plates 296, 298 are provided that are secured at intermediate pivot points 297, 299, respectively, to the upper plate defining the cam surfaces 288, 290, respectively. These curved plates have a section that extends outwardly beyond the cam surfaces 288, 290 and thus they are engaged by the pins 292, 294 on the suction cup assemblies 274, 278 secured to the rod 270 to pivot the curved plates about their respective pivots. The opposite ends of the curved plates 296, 298 engage the pins 300, 302 extending upwardly from the suction cup assemblies 264, 268 on the rod 262 to move them inwardly as the rod 270 moves to the end of its travel to expand the honeycomb.

The various mechanisms are now in the position shown in FIG. 5, minus the apples. That is to say that we have now placed the apples located on the carrier assembly 118 in the loading station 108 as typified by FIG. 22 and the expander tray is similarly located in the loading station with the honeycomb in the expanded condition to open the cells to receive the apples.

Reference will now be made to FIG. 33 which generally illustrates in somewhat greater detail that which is schematically illustrated in FIG. 5.

First, it is to be noted that in order to effectuate the movement of the apples off of the apple carrier assembly 118 and to move the apples 114 into the expanded honeycomb cells 113 after which the apples and expanded honeycomb and separator sheet 110 are dropped into a box, it is necessary to understand the operation of and the mechanisms involved with the vacuum housing assembly 170 which is reciprocated to accomplish the desired results. The housing 170 is vertically supported through the action of guide rods 171 that extend through bearings that are suitably affixed to the frame of the machine (see FIG. 3).

VI. VACUUM BOX ASSEMBLY

The vacuum housing assembly 170 is shown in the upper part of FIG. 3 and is operated through the action of a cylinder assembly 304 which is shown in the upper middle portion of FIG. 33. The operation of the cylinder to raise and lower the vacuum housing in the prescribed time sequence will be described in detail when discussing the electrical circuitry, but for the purposes of the present explanation its operation will be described with reference to the switching mechanisms that bring about the prescribed vertical movement of the vacuum box housing at the prescribed times.

Located within the right-hand portion of FIG. 3 are a motor, a compressor, blower assembly, and a vacuum pump. The blower assembly 309 is shown in more detail in FIG. 33 and in conjunction with the piston operated valve 306 shown in its two operative positions in FIGS. 34 and 35 acts to draw air through the vacuum housing to retain the apples in the cups 172 by the differential pressure acting thereon and to positively release the apples from the cups by blowing air through the housing. The flow arrows in FIG. 33 show the sucking action by the blower. The vacuum pump is for providing suction to the various suction cup assemblies used in conjunction with the separator sheets and expander tray and the compressor is for providing air under pressure to operate the various cylinders.

The vacuum housing 170 has secured to its lower and a plurality of cups 172 equal to the number of apples to be raised, which cups contact the apples and lift them up to a raised position (see FIG. 24). In this condition, the valve 164 is in the position shown in FIG. 34 in which the inlet 165 to the blower 309 is connected to the housing 170 to suck air through the housing and hold the apples in place while the outlet 166 of the blower is connected to atmosphere. The apple holding action results from the venturi effect created by the air flow around the apples and through the cups 172 into the vacuum housing, which results in a positive differential pressure acting against the apples to hold them in their respective cups while the vacuum housing is being raised and so long as the differential pressure above referred to exists.

Also depending from the vacuum housing 170 are a plurality of suction cups 174 which have passages connecting them to the vacuum housing 170 for reasons which will be discussed hereinafter.

When it is desired to release the apples from the cups, the valve 164 is moved to the position shown in FIG. 35 in which the inlet to the blower is connected to atmosphere and the outlet is connected to the housing 170 which positively directs atmospheric air into the housing, thus eliminating the pressure differential across the cups 172, tending to hold the apples therein and direct a positive air pressure against the apples.

VII. BOX LOADING SEQUENCE

Referring now to FIG. 22, the vacuum housing 170 is shown just prior to the cups 172 contacting the apples, after which it will raise them to thus permit the apple carrier assembly 118 to be moved back to the apple supply to obtain another layer of apples.

FIG. 23 shows the vacuum housing 170 being moved downwardly to where the apples are engaged and the pressure sensor switch 176 hits the plate 127 and the vacuum housing is raised to move it upwardly to the position shown in FIG. 24. As previously mentioned, the air flow past the apples, as shown in FIG. 33, will result in the apples being retained in the cups and being drawn upwardly with the cups to the position shown in FIG. 24.

The vacuum housing is subsequently sequenced so that after the apples have been raised and the carrier assembly has been moved out of the loading station, the vacuum housing is lowered to place the apples into the expanded honeycomb cells 113. The vacuum housing then moves downwardly to the position shown in FIG. 26 wherein the pressure sensing switch 176 engages the separator sheet 110 which then actuates the cylinder assembly 304 to again move the vacuum housing upwardly again. However, at this juncture, the suction cups 174 secured to the housing engage the separator sheet 110 with the result that when the vacuum housing raises, the separator sheet and the expanded honeycomb thereabove will also raise along with the apples as shown in FIG. 27. Following this, the timing is designed so that the expander tray 152 is moved out of the loading station 108 and the vacuum housing 170 is moved downwardly to dispose the layer of apples in the shipping box 102. At this time, a switch is actuated to move the valve 164 from the position shown in FIG. 34 to that shown in FIG. 35, with the result that atmospheric air will flow into the vacuum housing and the pressure differential will no longer exist on opposite sides of the apples. The apples will then not be raised along with the vacuum housing and will remain in the box in the honeycomb cells 113 when the cups 172 are raised. When the vacuum housing is raised, the sequencing events previously referred to will take place and another layer of apples will be introduced into the loading box. Suitable electrical circuitry is provided, so that when a requisite number of layers are loaded the conveyor will be lowered, the filled box taken out of position, and a new empty box placed in position to be loaded.

Reference is now made to the electrical schematic diagram shown in FIGS. 36A and 36B. This electrical circuit arrangement is meant to be general and schematic in nature and will contain the major components of the control mechanisms. The circuitry employed is only illustrative of any of a wide variety of usable arrangements and is not intended to be limiting. The one to be described is merely intended to give a broad overview of a usable system and it is to be understood that many details are not shown and would be apparent to a skilled technician. It is to be noted that it is assumed that the packaging machine when started finds the expander tray 152 having a separator sheet therein located outside of the loading station 108 and the apple carrier assembly 118 loaded with apples.

For ease of understanding, the components of the circuit are identified by name on the drawings, as well as where appropriate by number.

Referring now to the circuitry, when the start button is pressed, the motor operates the relays $R_1$, $R_2$, and $R_3$, which start the operation of the blower and vacuum pump and condition the conveyor to be started. When the vacuum pressure reaches a certain preselected amount, a pressure switch 318 closes the circuit to the conveyor, and the conveyor operates to bring a box into position in the loading station. When the box is in the loading station, it closes a box locator switch 185, and when this switch is closed, knife gates 106 are closed by closing the knife gate solenoid to retain the box in position. At the same time, the conveyor knife gate solenoid is closed the conveyor solenoid is operated to raise the conveyor by actuation of the conveyor cylinder lifting mechanism to raise the conveyor to its up position.

As previously mentioned, we are describing this consistent with the apple carrier assembly loaded and the expander tray out with these switches normally closed. When the box is located in place in the loading station, the carrier assembly solenoid is operated to move the carrier assembly 118 into the loading station. When the carriage 52 is located outside of the machine, it engages a microswitch 55 which actuates cylinders 82 and 53, respectively, to move the bottom support 68 underneath the apples and then move the carriage assembly 52 into the machine over the cups. With the cylinder 82 being much smaller than cylinder 53, the bottom support 68 is moved into position well prior to the time the carriage assembly is moved into the machine. When the carriage 52 is in place, a timer 57 is actuated and during a prescribed period the conveyor 119 is driven to feed apples into the carriage.

In the desired time sequence, a motor driven switch 320 is actuated, whereby the carrier assembly solenoid is actuated to move the carrier assembly into the loading station where the apples are to be removed and subsequently loaded into expanded honeycomb and dropped into a box.

Referring now to the upper part of FIG. 36B, it can be seen that with the expander tray out, the motor driven sequencing switch 322 is operated, which initially acts to move a separator sheet solenoid to the off position, since it is obvious that with the expander tray located outwardly of the loading station, the separator sheet solenoid cannot be operated, since it would conflict with the expander tray. At the second station of the sequencing switch, the honeycomb guillotine cylinder 248 is operated to move the guillotine 158 downwardly and direct a portion of compressed honeycomb into the expander tray 152.

It is to be remembered that we are assuming that with the expander tray in the out position, it has previously received a separator sheet in the bottom thereof.

When the motor-driven sequencing switch 322 moves to the third position, it operates to close the suction cups to move them into engagement with the opposite sides of the compressed honeycomb portion.

When the guillotine reaches the bottom of its travel, it hits a low limit switch 324 which reverses the guillotine cylinder 248 to raise it upwardly awaiting another cycle.

There is provided in the expander tray a switching mechanism so that when the honeycomb expander is fully closed, it closes a limit switch 326, which when closed expands the honeycomb by actuating the honeycomb expander cylinder 284, and at the same time turns on the vacuum to the expander cups.

As will be discussed later during a particular sequencing step, the vacuum to the expander cups is turned off through the action of relay $R_1$ operated by coil $C_1$.

Next illustrated in the schematic electrical diagram is a switch located in the loading station which is engaged by the carrier assembly when it is moved into position in the loading station. This switch acts to lower the vacuum housing assembly, which housing then moves downwardly until it engages the apples on the carrier assembly. When this occurs, the pressure sensitive switch 176 is actuated with the result that the vacuum housing 170 which has contacted the apples is lifted raising the apples with it. It is noted that during this time period the valve 306 is positioned by the slide valve solenoid so that the blower 309 is sucking air into the vacuum housing past the apples to create the pressure differential to maintain the apples in the cups 172 depending from the vacuum housing assembly. When the vacuum housing reaches the top of its travel, it hits another limit switch and the housing is lowered. This lowering of the housing disposes the apples in the expanded honeycomb cells 113, and the suction cups and the pressure sensitive switch engages the separator sheet. At this time in the operation, the coil $C_1$ is energized to activate the relay $R_1$ to release the vacuum to the expander cups so the expanded honeycomb is free of the cups and will be lifted out of the expander tray. The pressure sensitive switch 176 acts to again raise the vacuum housing and the cups 172 carry the apples upwardly and the suction cups 174 lift the separator sheet and the expanded honeycomb. At this time, the pressure differential switch in the vacuum housing is actuated to operate the expander tray cylinder 256 to move the expander tray out of the loading station. The vacuum housing is again reversed after it hits the top of its travel and will move downwardly, this time all the way through the station, into the shipping box 102, and a low limit switch 328 will be actuated, so that valve 306 will be shifted to have the blower push air into the housing 170 and release the vacuum and the apples, and the separator sheet and honeycomb will be free of the vacuum housing and remain in the box.

It is further to be noted that with the expander tray in the loading station, the separator sheet vacuum cylinder is operated to move it into the downward position to engage a top separator sheet, and at the same time the separator sheet vacuum solenoid is turned on to supply vacuum to the vacuum cups engaging the separator sheet, after which the top separator sheet from the stack is raised. The separator sheet cylinder will now be in the up position with a separator sheet located thereon. Accordingly, when the expander tray is moved out of the loading station, the separator sheet vacuum solenoid will be turned off, with the result that the separator sheet will be deposited onto the bottom of the expander tray. The expander tray will be conditioned to receive compressed honeycomb, etc., and the apple carrier assembly which has already been returned to the pick-up position is in place to receive another load of apples, and the sequence of steps will be started again to load another layer of apples in the box.

It is to be noted that a sequencing system can be set up, so that after predetermined layers of, for example, four, have been deposited in the box, the conveyor would be lowered and when it is in the lowered position, the machine would be stopped until the loaded box is carried away and another box is put in position. Following this, the sequence of steps referred to above will be started again.

The above apparatus has been shown used with the packaging of fruit, such as, apples, and employs a vacuum system for (1) drawing the materials to be packaged off of its carrier and (2) subsequently depositing them into the expanded honeycomb and into a shipping box.

It can be appreciated, however, that various mechanisms can be employed for handling the items to be packaged within the loading station. This could include various mechanical or electrical devices.

Referring specifically to FIGS. 37 and 38, there is shown a simplified illustration of a mechanical type of gripping configuration that could be used in raising the articles to be packaged. We will deal with apples, since that is what the present application has been directed to, but needless to say, this is but one example of the type of product to which the present invention can be directed. Particularly, it is noted that a mechanical type of apparatus, or an electrical mechanism would be more suitable when the weight of the article to be packaged does not lend itself to using the venturi air principle used and described in detail in the instant application.

Referring now more specifically to FIG. 37, there is shown an arrangement in which there is a plate 350 from which depend a plurality of cylindrical members 352 equal to the number of items to be raised, which cylindrical members 352 telescope into sleeves 354 secured to a lower plate member 356. The sleeve 354 includes at its lower end a slotted section 358 formed of flexible material designed to take the conical configuration shown in FIG. 38. Thus, the depression of the cylindrical members 352 results in expanding the lower sections 358. Accordingly, when the plate 356 is lowered to receive fruits, such as, the apple 360 shown in position in FIG. 38, the apples will fit therein, and upon upward movement of the cylindrical members 352, the lower portion 358 will compress around the fruit to retain it in position in the sleeve 354. Thus, when the lower plate 356 is raised, the fruit will be carried upwardly and held in the sleeve 354 until the cylindrical members 352 are again moved relative to sleeves 354 to expand section 358 and thereby release the fruit.

As previously mentioned, this is but one of a variety of mechanical constructions that can be used.

Another approach that can be used would be to use an electromagnetic system for packaging metal objects, such as, spark plugs, in a honeycomb structure.

It would also be possible to pack glass bottles, pharmaceuticals, aerosol cans, and other containers by employing some sort of mechanical activated plastic, or metal talons that will grip the material and act to gently place the product into the precision expanded honeycomb structural separators. Here again, this will obviously provide for a highspeed, relatively inexpensive packaging process which will at the same time eliminate the serious problems of breakage and surface abrasion.

The above embodiments are just a few of those which can be employed in the automatic packaging system herein described. Furthermore, while various mechanisms have been described for carrying the articles to be packaged, handling the articles in the loading station, expanding the honeycomb, etc., these are merely representative of those that can be employed.

It is, of course, intended to cover by the appended claims all such modifications and embodiments that fall within the true spirit and scope of the invention.

We claim:

1. A machine for automatically packaging articles into expanded honeycomb and into a container comprising means for locating a container at a loading station of the packaging machine to be filled and moving the container out of the loading station after it has been filled, means for providing a separator sheet into the container at the loading station, means for disposing a prescribed number of articles to be packaged as a layer in the container in a nested relationship in an article loading position, an article controlling housing assembly, means for automatically providing above said loading station a honeycomb expander tray on which is located an open honeycomb section for receiving articles and for removing the tray after the honeycomb section has been removed therefrom, means for moving the housing assembly and for lifting said articles from their article loading position, depositing them in said open honeycomb and subsequently lifting the filled honeycomb from said tray and then depositing the same in a container.

2. A packaging machine as set forth in claim 1 in which the means for locating the container at the loading station and for moving the container out of the loading station includes a conveyor which when actuated moves the container into the loading station, means for stopping the container at a prescribed location in the loading station, and means for lifting the container into the desired proximate location relative to said expander tray to receive the filled honeycomb and separator sheet, and for lowering the container after it has been filled.

3. A packaging machine as set forth in claim 1 in which the means for disposing a prescribed number of articles in a nested relationship includes means for loading articles to be packaged on a carrier assembly disposed outside of the loading station, means for moving said carrier assembly into and out of the loading station of the packaging machine, a carriage assembly for holding the articles to be packaged adjacent the carrier assembly, guide means for guiding the articles from said carriage assembly onto the carrier assembly into the desired position relative thereto, and track means for guiding the carrier assembly into and out of the loading station in the prescribed sequence during the operation of the machine.

4. A packaging machine in accordance with claim 3 in which the carriage assembly includes a plurality of chute sections and means for retaining the articles in the carriage assembly as it is moved into the machine.

5. A packaging machine in accordance with claim 4 in which the means for retaining the articles in the carriage assembly includes end stop means and a bottom support.

6. A packaging machine in accordance with claim 3 in which the carrier assembly includes a plurality of cup members for receiving the articles to be packaged.

7. A packaging machine in accordance with claim 6 including means for adjusting the position of the cups into a nested relationship for accurately locating the articles relative to the expanded honeycomb provided for same.

8. A packaging machine in accordance with claim 7 in which the housing assembly includes a vacuum housing depending therefrom a plurality of cups constructed and arranged to engage the articles located on the carrier assembly, and wherein the means for moving the housing assembly includes cylinder means for raising and lowering said vacuum box into and out of contact with said articles, and further including means for providing a suction in said housing whereby when the cups engage the articles air acting to flow into the vacuum box will cause a pressure differential tending to hold the articles in position relative to the cups and for admitting atmospheric air to said vacuum box to release the articles from the cups when the filled honeycomb is deposited in the box to be filled.

9. A packaging machine in accordance with claim 8 in which the means for providing a separator sheet includes a first suction cup assembly located adjacent the loading station, and means for operating said first suction cup assembly to contact the upper sheet of a stack of separator sheets and subsequently dropping a sheet into the bottom of said expander tray, and second suction cup assemblies connected to said vacuum housing engaging the separator sheet and raising it along with the expanded honeycomb.

10. Method of automatically packaging articles in a shipping box including the steps of disposing articles in a nested relationship, providing in a loading station an expanded honeycomb section, raising the articles while maintaining the nested relationship, depositing the articles in the expanded honeycomb, raising the filled honeycomb, providing a separator sheet and depositing the filled honeycomb into a box.

11. A method as set forth in claim 10 wherein the step of disposing the articles in a nested relationship includes the steps of initially placing a preselected quantity of articles in a carriage assembly, adjusting a carrier, retaining the articles in said carriage assembly, moving the carriage assembly above the carrier, and then depositing the articles in the carrier.

12. A method as set forth in claim 10 wherein the articles located in the carrier are repositioned to conform the location to that of the expanded honeycomb section.

13. A method as set forth in claim 10 in which the step of providing an expanded honeycomb in the loading station consists of first depositing a compressed sheet of honeycomb into a tray disposed outside the loading station, expanding the honeycomb and retaining it in the expanded condition in the tray while moving the tray into the loading station.

14. A method as set forth in claim 11 in which the steps of raising the articles off the carrier, placing the articles into the expanded honeycomb, then raising the articles, and expanded honeycomb and depositing the articles and expanded honeycomb into the box includes the steps of first gripping the articles to remove them from the carrier and moving the articles to a raised position, removing the carrier and lowering the articles into the expanded honeycomb and then raising the articles and expanded honeycomb off the expander tray in which it has been located and then removing the expander tray.

* * * * *